United States Patent [19]

Katoh et al.

[11] Patent Number: 5,030,547

[45] Date of Patent: Jul. 9, 1991

[54] SILVER HALIDE PHOTOGRAPHIC MATERIAL

[75] Inventors: Kazunobu Katoh; Morio Yagihara, both of Kanagawa, Japan

[73] Assignee: Fuji Photo Film Co., Ltd., Kanagawa, Japan

[21] Appl. No.: 373,019

[22] Filed: Jun. 28, 1989

[30] Foreign Application Priority Data

Jun. 28, 1988 [JP] Japan ..... 63-159886

[51] Int. Cl.[5] ..... G03C 1/06

[52] U.S. Cl. ..... 430/264; 430/487; 430/490; 430/445; 430/446

[58] Field of Search ..... 430/264, 487, 490, 445, 430/446

[56] References Cited

U.S. PATENT DOCUMENTS

| | | | |
|---|---|---|---|
| 4,269,929 | 5/1981 | Nothnagle | 430/264 |
| 4,429,036 | 1/1984 | Hirano et al. | 430/264 |
| 4,447,522 | 5/1984 | Hirano et al. | 430/264 |
| 4,740,452 | 4/1988 | Okutsu et al. | 430/445 |
| 4,851,321 | 7/1989 | Takagi et al. | 430/264 |
| 4,914,009 | 4/1990 | Ueda et al. | 430/445 |
| 4,925,832 | 5/1990 | Hall et al. | 430/264 |

FOREIGN PATENT DOCUMENTS 0253665 1/1988 European Pat. Off. .

*Primary Examiner*—Charles L. Bowers, Jr.
*Assistant Examiner*—Thomas R. Neville
*Attorney, Agent, or Firm*—Sughrue, Mion, Zinn, Macpeak & Seas

[57] ABSTRACT

A negative-type silver halide photographic material is disclosed, which comprises a support having provided thereon at least one hydrophilic colloid layer, at least one of which is a silver halide emulsion layer, wherein the hydrophilic colloid layer contains:

(a) a compound represented by formula (I):

(I)

wherein, $A_1$ and $A_2$ both represent hydrogen atoms, or one represents a hydrogen atom and the other a sulfonyl group or an acyl group, $R_1$ represents an aliphatic group, an aromatic group or a heterocyclic group, $G_1$ represents a carbonyl group, a sulfonyl group, a sulfoxy group, wherein $R_2$ is an alkoxy group or an aryloxy group, a group, or an iminoethylene group, $X_1$ is a moiety which instigates a ring-forming reaction by cleaving the $—G_1—X_1$ moiety from the residual molecule and forming a cyclic structure containing the atoms of the $—G_1—X_1$ moiety; and (b) an amine, the compound represented by formula (I) and the amine being present in the same layer or in different layers.

14 Claims, No Drawings

SILVER HALIDE PHOTOGRAPHIC MATERIAL

FIELD OF THE INVENTION

This invention concerns silver halide photographic materials and a method of forming superhigh contrast images using these materials, and in particular it concerns silver halide photographic materials which are used in photomechanical processes.

BACKGROUND OF THE INVENTION

To improve the reproduction of line images and the reproduction of continuous tone images with screen dot type images in the graphic arts field, image forming systems which have superhigh contrast (especially with a gamma value in excess of 10) photographic characteristics are required.

Known methods for obtaining high contrast photographic characteristics using stable developers involving the use of hydrazine derivatives have been disclosed, for example, in U.S. Pat. Nos. 4,224,401, 4,168,977, 4,166,742, 4,311,781, 4,272,606 and 4,211,857. Photographic characteristics of superhigh contrast and high speed can be attained using these methods, and since it is possible to add high concentrations of sulfite to the developer, the stability of the developer with respect to aerial oxidation is much better than that observed in the case of a lith developer.

However, increasing contrast with the use of these hydrazine derivatives has, in the past, required the use of a developer which has a comparatively high pH such as the pH value of at least 11.2. Because of the high pH, the developer is liable to adsorb carbon dioxide from the air resulting in the likelihood of the pH falling. Existing developers have not been sufficiently stable with respect to this aerial oxidation. Satisfactorily high contrast is not obtained when the developer pH is less than 11.2, good screen dots are not formed, and the system is unsatisfactory for the reproduction of line images.

Attempts have been made to increase the activity of hydrazine derivatives as a wa of increasing contrast at a lower pH of less than 11.2. For example, hydrazines which have substituent groups which are readily absorbed on silver halide grains have been disclosed, for example, in JP-A-60-179734, JP A-62 948, and U.S. Pat. Nos. 4,385,108, 4,269,929 and 4,243,739. (The term "JP-A" as used herein signifies an "unexamined published Japanese patent applicaiton".) Furthermore, hydrazines which undergo an intramolecular cyclization reaction in the presence of oxidized hydroquinone have been disclosed in JP-A-63-29751.

However, even these highly active hydrazines are inadequate when the pH is less than 11.2.

On the other hand, various compounds have been proposed as high contrast accelerators in JP-A-61-165752, JP-A-63-124045 and JP-A-63-133145 but although development is accelerated with these accelerators however, pH of the developer can not be reduced.

There is an additional problem in that marked changes occur in photographic performance as the pH of the developer changes. Even with slight changes in pH (e.g., fluctuation of 0.2 or more in the pH value) the area of screen dots may change and the widths of the lines in line images may change and this creates problems.

SUMMARY OF THE INVENTION

An object of the present invention is to attain a satisfactorily high contrast with a low pH developer and to minimize the changes in photographic performance which arise as the developer pH changes.

The present invention attains this by a negative-type silver halide photographic material comprising a support having provided thereon at least one hydrophilic colloid layer, at least one of which is a silver halide emulsion layer, wherein the hydrophilic colloid layer contains:

(a) a compound represented by formula (I):

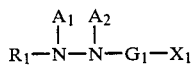

(I)

wherein, $A_1$ and $A_2$ both represent hydrogen atoms, or one represents a hydrogen atom and the other a sulfonyl group or an acyl group, $R_1$ represents an aliphatic group, an aromatic group or a heterocyclic group, $G_1$ represents a carbonyl group, a sulfonyl group, a sulfoxy group, a

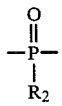

group wherein $R_2$ is an alkoxy group or an aryloxy group, a

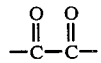

group, or an iminomethylene group, $X_1$ is a moiety which instigates a ring-forming reaction by cleaving the $—G_1—X_1$ moiety from the residual molecule and forming a cyclic structure containing the atoms of the $—G_1—X_1$ moiety; and (b) an amine.

DETAILED DESCRIPTION OF THE INVENTION

General formula (I) is described in more detail below.

$A_1$ and $A_2$ in general formula (I) are hydrogen atoms, alkylsulfonyl groups or arlysulfonyl groups which have not more than 20 carbon atoms (preferably phenylsulfonyl groups or substituted phenylsulfonyl groups of which the sum of the Hammett substituent constants is not less than −0.5), acyl groups which have not more than 20 carbon atoms (preferably benzoyl groups or substituted benzoyl groups of which the sum of the Hammett substituent constants is not less than −0.5) or linear chain, branched chain or cyclic unsubstituted or substituted aliphatic acyl groups (with halogen atoms, ether groups, sulfonamido groups, carbonamido groups, hydroxyl groups, carboxyl groups, sulfonic acid groups, for example, as substituent groups), and those cases in which both $A_1$ and $A_2$ represent hydrogen atoms are most desirable.

The aliphatic groups represented by $R_1$ are linear chain, branched chain or cyclic alkyl groups having 1 to 18 carbon atoms, alkenyl groups having 2 to 18 carbon atoms or alkynyl groups having 2 to 18 carbon atoms.

The aromatic groups represented by $R_1$ are monocyclic or bicyclic aryl groups (for example, phenyl, naphthyl).

The heterocyclic rings represented by $R_1$ are from three to ten membered, saturated or unsaturated, heterocyclic groups which contain at least one nitrogen, oxygen or sulfur atom. They may consist of a monocyclic ring or they may take the form of a condensed ring. For example, a heterocyclic ring may be condensed with an aromatic ring or with another heterocyclic ring. Five or six membered aromatic heterocyclic rings are preferred and those which contain a pyridyl group, an imidazolyl group, a quinolinyl group, a benzimidazolyl group, a pyrimidyl group, a pyrazolyl group, an isoquinolinyl group, a thiazolyl group or a benzthiazolyl group are particularly preferred.

$R_1$ may be substituted with substituent groups.

Examples of such substituent groups include alkyl groups, aralkyl groups, alkoxy groups, aryl groups, substituted amino groups, acylamino groups, sulfonylamino groups, ureido groups, urethane groups, aryloxy groups, sulfamoyl groups, carbamoyl groups, alkylthio groups, arylthio groups, sulfonyl groups, sulfinyl groups, hydroxyl groups, halogen atoms, cyano groups, sulfo groups, and carboxyl groups.

These groups may be joined together, where possible, to form rings. These groups may also be substituted with substituent groups described above.

Aromatic groups, especially aryl groups, are preferred for $R_1$.

$G_1$ represents a carbonyl group, a sulfonyl group, a sulfoxy group, a

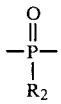

group (where $R_2$ represents an alkoxy group having 1 to 18 carbon atoms or an aryloxy group having 6 to 18 carbon atoms), a

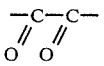

group or an iminomethylene group, and the carbonyl group is most desirable for $G_1$.

$X_1$ is a group which can be further represented by the general formula (a):

$$-L_1-Z_1 \qquad (a)$$

wherein $Z_1$ is a group which subjects $G_1$ to a nucleophilc attack and splits $G_1$—$L_1$—$Z_1$ off from the rest of the molecule and $L_1$ is a divalent organic group which can form a ring structure with $G_1$, $L_1$ and $Z_1$ following a nucleophilic attack on $G_1$.

$Z_1$ is a group that will readily subject $G_1$ to nucleophilic attack when $$R_1-N=N-G_1-L_1-Z_1$$

is formed as a reaciton intermediate by an oxidation reaction, for example, of a hydrazine compound of general formula (I); and will split the $R_1$—N=N— group off from $G_1$.

Some actual examples of $Z_1$ are —OH; —SH; —$NHR_3$ (where $R_3$ represents a hydrogen atom, an alkyl group having 1 to 18 carbon atoms, an aryl group having 6 to 18 carbon atoms, a heterocyclic group, a —$COR_4$ group or an —$SO_2R_4$ group, where $R_4$ represents a hydrogen atom, an alkyl group having 1 to 18 carbon atoms, an aryl group having 6 to 18 carbon atoms or a heterocyclic group, for example), and a —COOH group, for example, being a functional group which reacts directly with $G_1$ (here the —OH, —SH, —$NHR_3$, or —COOH group may be temporarily protected in such a way that the group is formed by hydrolysis with an alkali).

$Z_1$ may also be a functional group such as

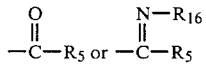

that reacts with a nucleophilic agent such as hydroxyl ion or sulfite ion prior to reacting with $G_1$. Where $R_5$ and $R_6$ represent hydrogen atoms, alkyl groups having 1 to 18 carbon atoms, alkenyl groups having to 18 carbon atoms, aryl groups having 6 to 18 carbon atoms or heterocyclic groups.

The divalent organic group represented by $L_1$ may be an atom or a group of atoms including at least one carbon, nitrogen, sulfur or oxygen atom. Some actual examples of such groups are alkylene groups, alkenylene groups, alkynylene groups, arylene groups, heteroarylene groups (these groups may have substituent groups), —O—, —S—,

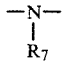

—N=, —CO—, or —$SO_2$—, either individually or in combinations. Where $R_7$ represents a hydrogen atom, an alkyl group having 1 to 18 carbon atoms or an aryl group having 6 to 18 carbon atoms. It is more desirable that the ring formed by $G_1$, $Z_1$ and $L_1$ should be a five or six membered ring.

The preferred groups represented by the general formula (a) are represented by general formula (b) or general formula (c).

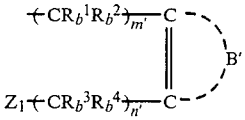

In general formula (b), $R_b^1$–$R_b^4$ represent, hydrogen atoms, alkyl groups (which preferably have from 1 to 12 carbon atoms), alkenyl groups (which preferably have from 2 to 12 carbon atoms) or aryl groups (which preferably have from 6 to 12 carbon atoms), and they may be the same or different. B′ represents the atoms required to complete a five or six membered ring which may have substituent groups. The indicator m′ and n′ each have a value of 0 or 1. When $Z_1$ is a —COOH group, (m′+n′)has a value of 0 or 1. When $Z_1$ is an —OH group, an —SH group or an —$NHR_3$ group then (m′+n′) has a value of 1 or 2.

Some specific examples of five and six membered rings that B′ can form are cyclohexene, cyclopentene, benzene, naphthalene, pyridine, and quinoline rings. $Z_1$ has the same significance as in general formula (a).

Compounds represented by general formula (b) in which m'=0 and n'=1 are preferred, and those in which the ring formed by B' is a benzene ring are especially desirable.

General Formula (c)

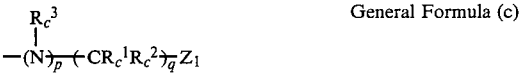

In general formula (c), $R_c^1$ and $R_c^2$ represent hydrogen atoms, alkyl groups having 1 to 18 carbon atoms, alkenyl groups having 2 to 18 carbon atoms, aryl groups having 6 to 18 carbon atoms or halogen atoms, and they may be the same or different.

$R_c^3$ represents a hydrogen atom, an alkyl group, an alkenyl group or an aryl group.

$Z_1$ has the same significance as in general formula (a).

The indicator p represents 0 or 1, and q represents a number of value from 1 to 4.

$R_c^1$, $R_c^2$ and $R_c^3$ may be joined together to form a ring provided that the structure allows for intramolecular nucleophilic attack by $Z_1$ on $G_1$.

$R_c^1$ and $R_c^2$ preferably represent hydrogen atoms, halogen atoms or alkyl groups, and $R_c^3$ preferably represents an alkyl group or an aryl group.

Preferably, q has a value of from 1 to 3, and when q is 1, p is 1; when q is 2, p is 0 or 1; and when q is 3, p is 0 or 1. When q has a value of 2 or 3, the $CR_c^1R_c^2$ groups may be the same or different.

The substituent groups for $X_1$ include those described in conneciton with $R_1$ and, the following additional groups: acyl groups acyloxy groups, alkyl or aryl oxycarbonyl groups, alkenyl groups, alkynyl groups and nitro groups. These substituent groups may be further substituted with these substituent groups. Furthermore, in cases where it is possible, these groups may be joined together to form rings.

$R_1$ or $X_1$, preferably $R_1$, includes a so-called ballast group. That is, a group used to render a coupler fast to the diffusion. Such ballast groups consist of one or a combination of more than one of the following general groups that have at least 8 carbon atoms: alkyl group, phenyl group, ether group, amido group, ureido group, urethane group, sulfonamido group, and thioether group.

$R_1$ or $X_1$ may contain a group $Y_1(L_2)l$ which promotes the adsorption of the compound represented by the general formula (I) on the surface of silver halide grains. $Y_1$ is the group which promotes adsorption on silver halide, $L_2$ is a divalent linking group, and l has a value of 0 or 1.

Preferred examples of $Y_1$, which promote adsorption on silver halide are thioamido groups, mercapto groups, groups which have disulfide linkages, and five and six membered nitrogen-containing heterocyclic groups.

The thioamido adsorption promoting groups represented by $Y_1$ are divalent groups which can be represented by

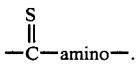

These may form part of a ring structure or they may be a non-cyclic thioamido group. Useful thioamido adsorption promoting groups may be selected from among those disclosed, for example, in U.S. Pat. Nos. 4,030,925, 4,031,127, 4,080,207, 4,245,037, 4,255,511, 4,266,013, and 4,276,364 and in *Research Disclosure,* Vol. 151, No. 15162 (November, 1976) and *Research Disclosure,* Vol. 176, No. 17626 (December, 1978).

Actual examples of non-cyclic thioamido groups include thioureido groups, thiourethane groups and dithiocarbamic acid ester groups. Actual examples of cyclic thioamido groups include 4-thiazolin-2-thione, 4-imidazolin-2-thione, 2-thiohydantoin, rhodanine, thiobarbituric acid, tetrazolin-5-thione, 1,2,4-triazolin-3-thione, 1,3,4-thiadiazolin-2-thione, 1,3,4-oxadiazolin-2-thione, benzimidazolin-2-thione, benzoxazolin-2-thione, and benzothiazolin-2-thione. The cyclic thioamido groups may have substituent groups.

The mercapto groups of $Y_1$ may be aliphatic mercapto groups, aromatic mercapto groups or heterocyclic mercapto groups. (For those cases where there is a nitogen atom adjacent to the carbon atom to which the —SH group is bonded, the groups are the same as the cyclic thioamido groups with which they are related tautomerically. Examples of such groups are the same as those described in the paragraph above).

The five or six membered nitrogen-containing heterocyclic groups represented by $Y_1$ are five or six membered heterocyclic groups consisting of combinations of nitrogen, oxygen, sulfur and carbon atoms. Preferred heterocycles include, for example, benzotriazole, triazole, tetrazole, indazole, benzimidazole, imidazole, benzothiazole, thiazole, benzoxazole, oxazole, thiadiazole, oxadiazole and triazine rings. These groups may be further substituted with the substituent groups discussed for $R_1$ above.

Of the groups which can be represented by $Y_1$, the cyclic thioamido groups (for example the mercapto substituted nitrogen-containing heterocyclic rings, for example the 2-mercaptothiadiazole group, the 3-mercapto-1,2,4-triazole group, the 5-mercaptotetrazole group, the 2-mercapto-1,3,4-oxadiazole group or the 2-mercaptobenzoxazole group) or the nitrogen-containing heterocyclic groups (for example, the benzotriazole group, the benzimidazole group or the indazole group) are preferred. Furthermore, two or more of the $Y_1$—$(L_2)l$-groups may be substituted, and these may be the same or different.

The divalent linking group represented by $L_2$ is a single atom or a group of atoms including at least one of a carbon, nitrogen, sulfur and oxygen atoms. Acutal examples include alkylene groups, alkenylene groups, alkynylene groups, arylene groups, —O—, —S—, —NH—, —N=, —CO— and —$SO_2$— (these groups may have substituent groups) and these groups may be used individually or in the form of combinations.

Actual examples of $L_2$ are indicated below:

—CONH—, —NHCONH—, —$SO_2$NH—,

—COO—, —NHCOO—,

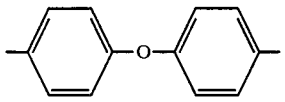

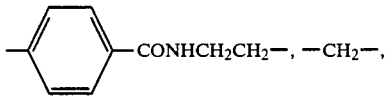

-continued
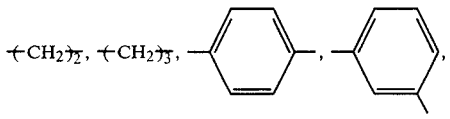
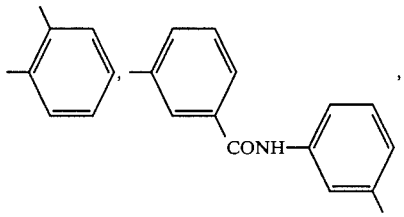
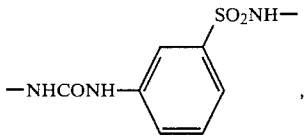
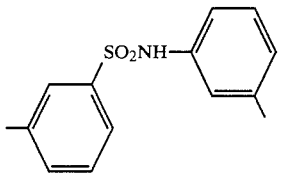
-continued
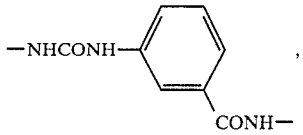
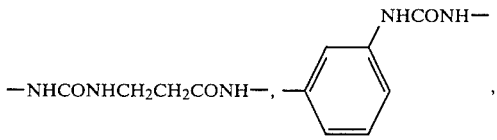
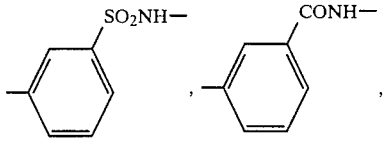
$-CH_2CH_2SO_2NH-$ and $-CH_2CH_2CONH-$.
These $L_2$ groups may be substituted with the substituent groups described for $R_1$.
Actual examples of compounds which can be represented by the general formula (I) are indicated below, but the invention is not limited by these examples.
(I-1)
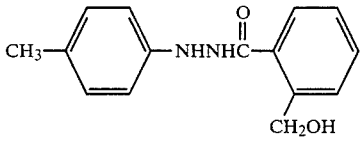
(I-2)
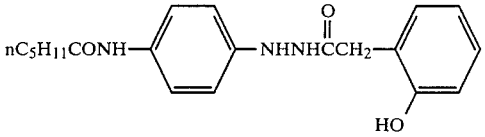
(I-3)
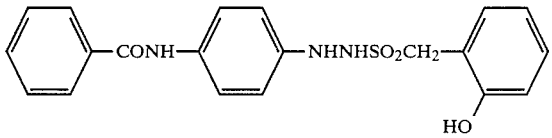
(I-4)
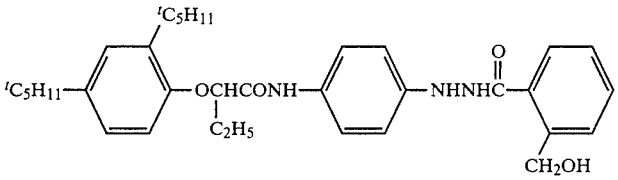
(I-5)
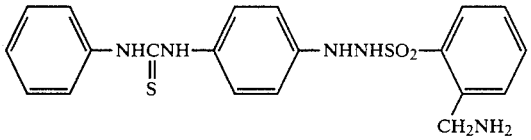

-continued
(I-6)
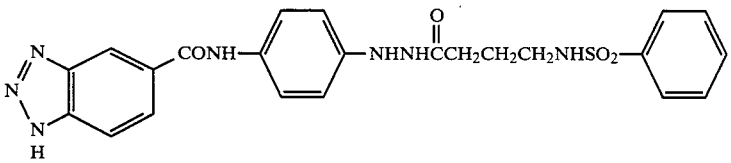
(I-7)
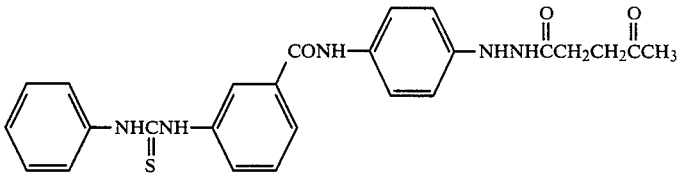
(I-8)
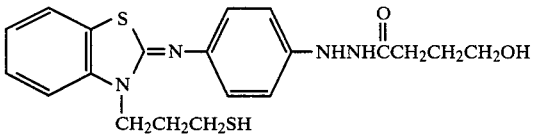
(I-9)
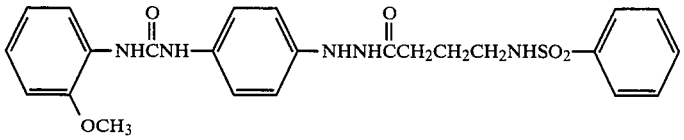
(I-10)
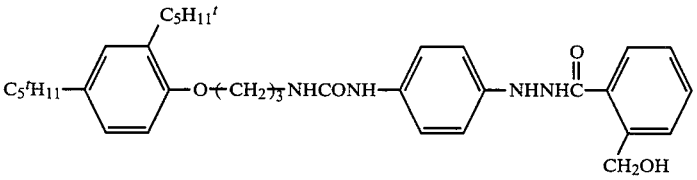
(I-11)
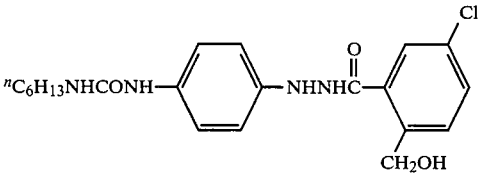
(I-12)
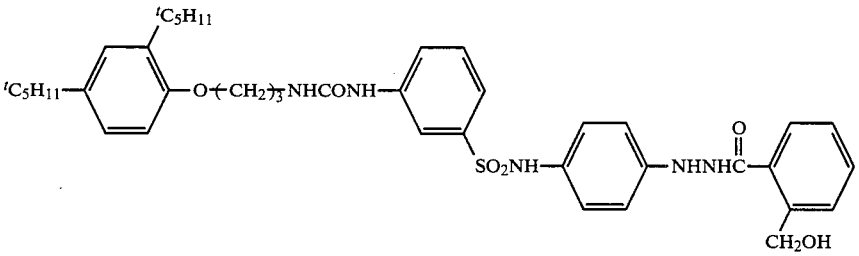
(I-13)
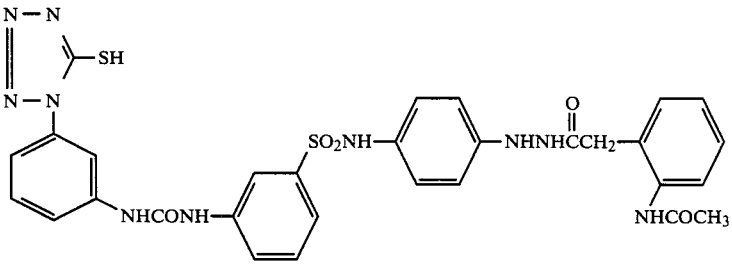

-continued
(I-14)
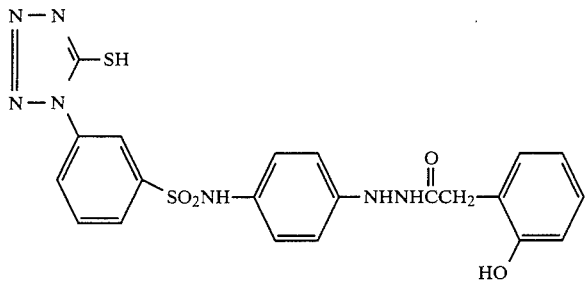
(I-15)
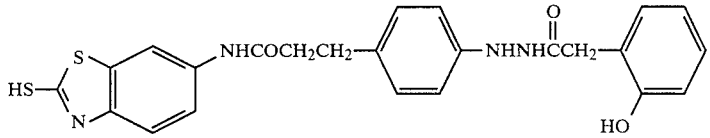
(I-16)
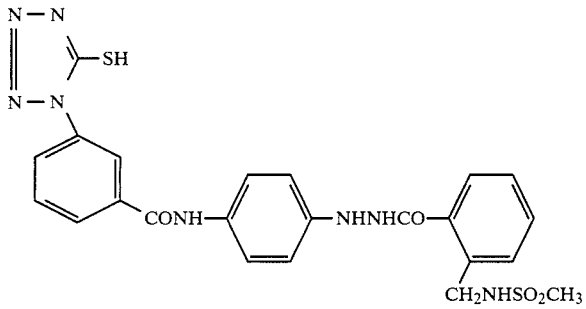
(I-17)
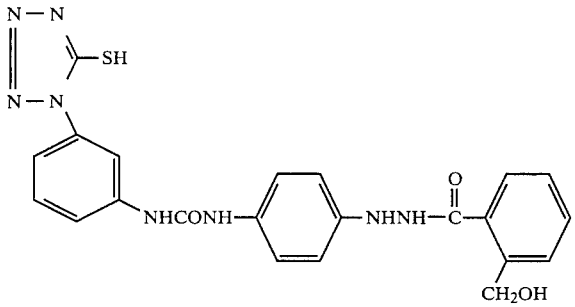
(I-18)
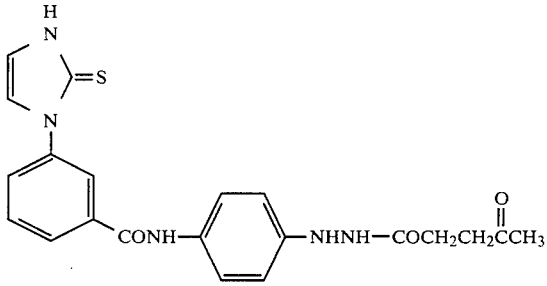
(I-19)
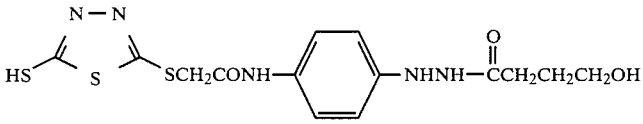
(I-20)
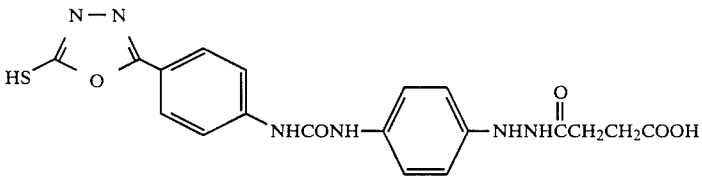

-continued
(I-21)
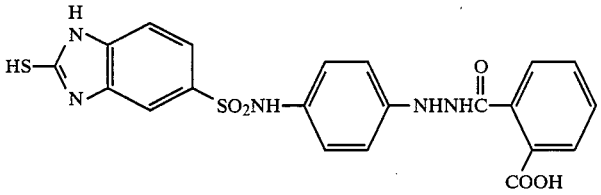
(I-22)
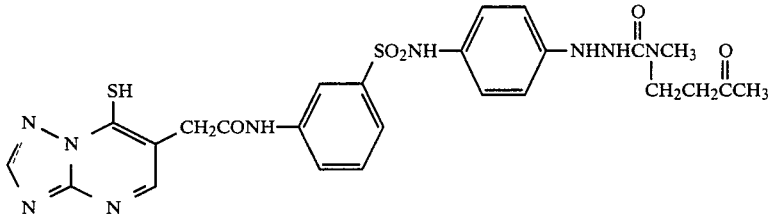
(I-23)
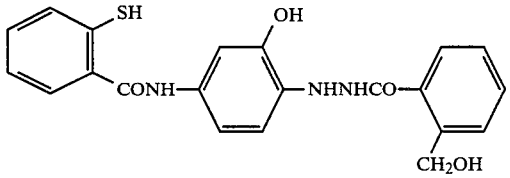
(I-24)
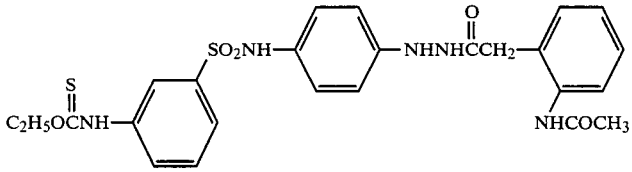
(I-25)
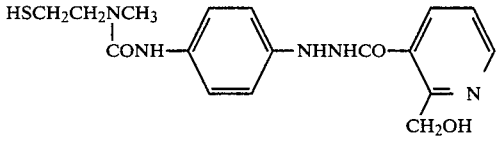
(I-26)
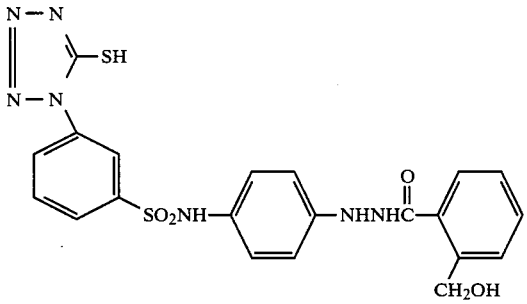
(I-27)
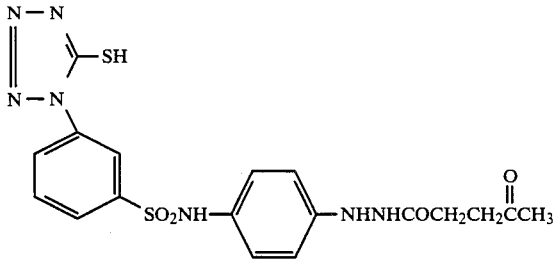

-continued
(I-28)
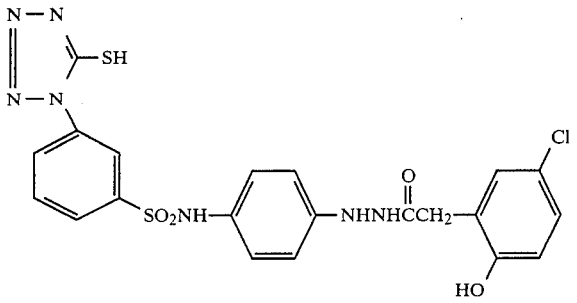
(I-29)
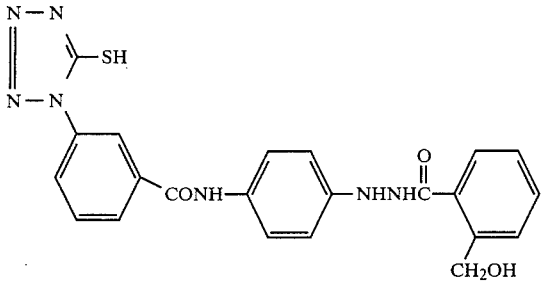
(I-30)
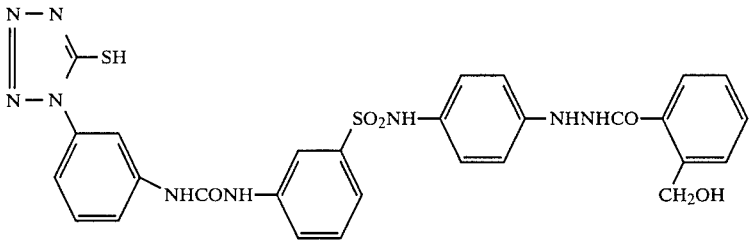
(I-31)
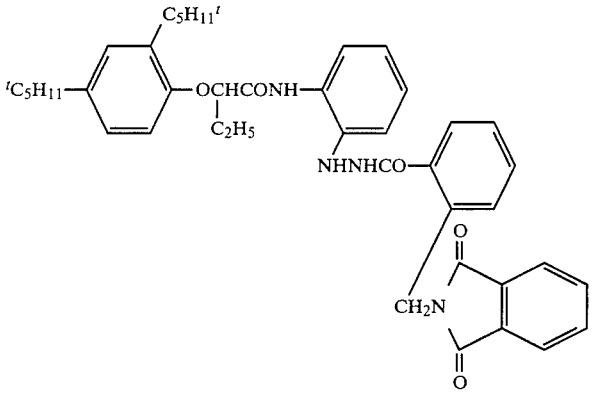
(I-32)
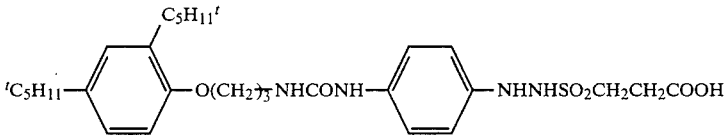
(I-33)
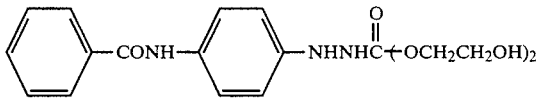
(I-34)
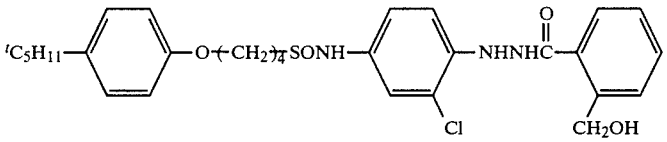

-continued (I-35)

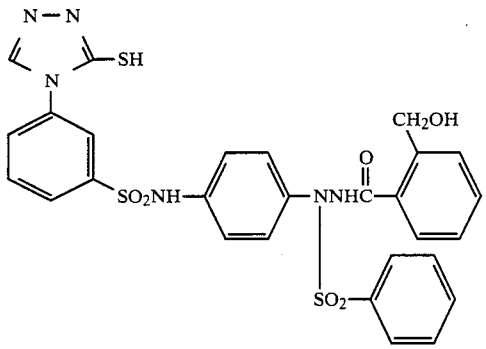

(I-36)

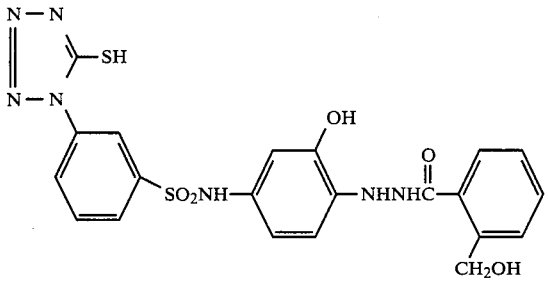

(I-37)

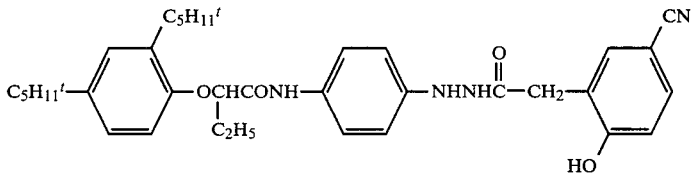

(I-38)

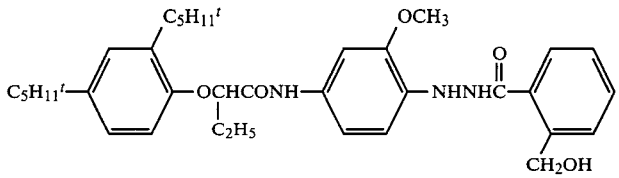

(I-39)

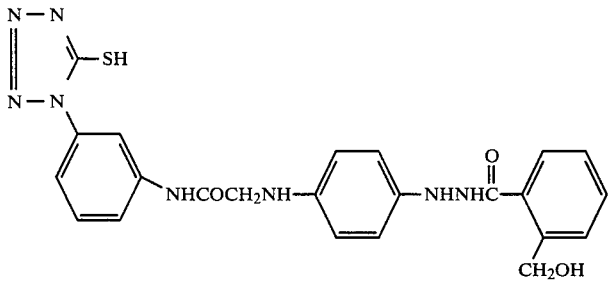

The hydrazine compounds disclosed in JP-A-62-270948, JP-A-63-121838, JP-A-63-129337, JP-A-63-234244, JP-A-63-234245, JP-A-63-294552, JP-A-63-306438, JP-A-1-10233, and JP-A-63-29751 can also be used in this present invention.

Inorganic and organic amines are included among the amines which can be used in the present invention. The organic amines include aliphatic amines, aromatic amines, cyclic amines, aliphatic-aromatic cyclic amines and heterocyclic amines. Primary, secondary or tertiary amines or quaternary ammonoium compounds can all be used. The amines disclosed in JP-A-56-106244, JP-A-60-140340, JP-A-61-251846, JP-A-60-218642, JP-A-60-258537, JP-A-61-267759, JP-A-62-211647, JP-A-62-55642 and JP-A-62-222241. The use of compounds disclosed in the above-described patents that are fast to the diffusion as a result of having ballast groups for photographic purposes, or compounds which can be adsorbed on silver halides and fixed in a hydrophiclic colloid layer, are preferred since they do not wash out into the developer during development processing. Thus, there is no reduction of the accelerating effect and no contamination of the processing bath.

The compounds disclosed in JP-A-62-22241 are preferred examples of amines of the type which are fast to the diffusion.

Amines which can be represented by the general formula (II) indicated below are especially desirable.

$$Y_o\text{-}[(A_o)_n B]_m \qquad \text{(II)}$$

In this formula, $Y_o$ represents a group which promotes adsorption on silver halide, $A_o$ represents a divalent linking group, B represents an amino group, an ammonium group or a nitrogen-containing heterocyclic group, m represents a value of 1, 2 or 3, and n represents a value of 0 or 1.

Examples of the groups which promote adsorption on silver halide represented by $Y_o$ in general formula (II) include nitrogen-containing heterocyclic groups, groups which have a thioamido linkage, groups which have a mercapto group and groups which have a disulfide linkage.

In those cases where $Y_o$ represents a nitrogen-containing heterocyclic group the compounds of general formula (II) can be represented by the general formula (V) indicated below.

General Formula (V)

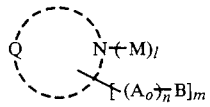

In this formula, l represents a value of 0 or 1, $-[(A_o)_n-B]_m$ has the same significance as in the aforementioned general formula (II), and Q represents a group of atoms which is required to form a five or six membered heterocyclic ring constructed from at least one type of atom selected from among the following: carbon, nitrogen, oxygen, sulfur, selenium, and tellurium atoms. Furthermore, this heterocyclic ring may have a condensed hydrocarbon aromatic ring or hegterocyclic aromatic ring.

Examples of heterocyclic rings which can be formed by Q include substituted or unsubstituted indazoles, benzimidazoles, benzotriazoles, benzoxazoles, benzthiazoles, benzselenazoles, benztellurazoles, imidazoles, thiazoles, selenazoles, oxazoles, tellurazoles, triazoles, tetrazoles, oxazolines, imidazolines, thiazolines, selenazolines, indolenines, azaindenes, pyrazoles, indoles, traizines, pyrimidines, pyridines and quinolines. The benzotriazoles, triazoles, azaindenes and triazines are preferred as nitrogen-containing heterocyclic rings, and of these the benzotriazoles are the most desirable.

Furthermore, these heterocyclic rings may be substituted with nitro groups, halogen atoms (for example, chlorine, bromine), mercapto groups, cyano groups, substituted or unsubstituted alkyl groups (for example, methyl, ethyl, propyl, t-butyl, cyanoethyl, methoxyethyl, methylthioethyl), aryl groups (for example, phenyl, 4-methane-sulfonamidophenyl, 4-methylphenyl, 3,4-dichlorophenyl, naphthyl), alkenyl groups (for example, allyl), aralkyl groups (for example, benzyl, 4-methylbenzyl, phenethyl), alkoxy groups (for example, methoxy, ethoxy), aryloxy groups (for example, phenoxy, 4-methoxy-phenoxy), alkylthio groups (for example, methylthio, ethylthio, methoxyethylthio), arylthio groups (for example, phenylthio), sulfonyl groups (for example, methanesulfonyl, ethanesulfonyl, p-toluenesulfonyl), carbamoyl groups (for example, unsubstituted carbamoyl, methylcarbamoyl, phenylcarbamoyl), sulfamoyl groups (for example, unsubstituted sulfamoyl, methylsulfamoyl, phenylsulfamoyl), carbonamido groups (for example, acetamido, benzamido), sulfonamido groups (for example, methanesulfonamido, benzenesulfonamido, p-toluenesulfonamido), acyloxy groups (for example, acetyloxy, benzoyloxy), sulfonyloxy groups (for example, methanesulfonyloxy), ureido groups (for example, unsubstituted ureido, methylureido, ethylureido, phenylureido), thioureido groups (for example, unsubstituted thioureido, methylthioureido), acyl groups (for example, acetyl, benzoyl), heterocyclic groups (for example, 1-morpholino, 1-piperidino, 2-pyridyl, 4-pyridyl, 2-thienyl, 1-pyrazolyl, 1-imidazolyl, 2-tetrahydrofuryl, tetrahydrothienyl), oxycarbonyl groups (for example, methoxycarbonyl, phenoxycarbonyl), oxycarbonylamino (for example, methoxycarbonylamino, phenoxycarbonylamino, 2-ethylhexyloxycarbonylamino), amino groups (for example, unsubstituted amino, dimethyamino, methoxyethylamino, anilino), carboxylic acid groups and salts thereof, sulfonic acid groups and salts thereof, and hydroxyl groups.

The divalent linking group represented by $A_o$ is a divalent linking group comprising an atom or group of atoms selected from among the carbon, nitrogen, oxygen and sulfur atoms, and examples of such groups include linear chain or branched chain alkylene groups (for example, methylene, ethylene, propylene, butylene, hexylene, 1-methylethylene), linear chain or branched chain alkenylene groups (for example, vinylene, 1-methylvinylene), linear chain or branched chain aralkylene groups (for example, benzylidene), linear or branched chain alkynylene groups (for example, $-CH_2-C{=}C-CH_2-$), arylene groups (for example, phenylene, naphthylene),

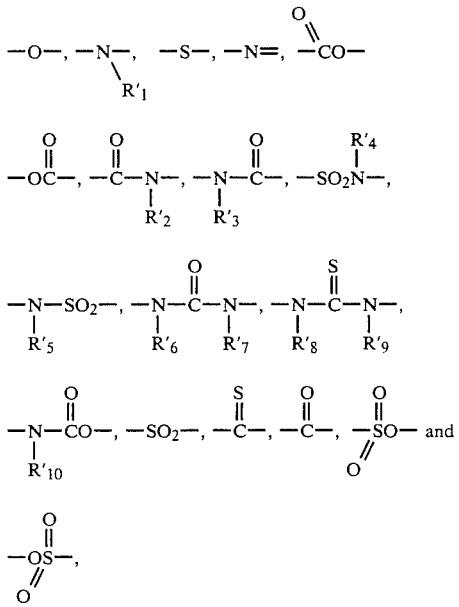

and linking groups may be formed with arbitrary combinations of these groups.

$R'_1$, $R'_2$, $R'_3$, $R'_4$, $R'_5$, $R'_6$, $R'_7$, $R'_8$, $R'_9$ and $R'_{10}$ represent hydrogen atoms, substituted or unsubstituted alkyl groups (for example, methyl, ethyl, propyl, n-butyl), substituted or unsubstituted aryl groups (for example, phenyl, 2-methylphenyl), substituted or unsubstituted alkenyl groups (for example, propenyl, 1-methylvinyl), or substituted or unsubstituted aralkyl groups (for example, benzyl, phenethyl).

The substituted or unsubstituted amino groups for B can be represented by the general formula (VI) indicated below.

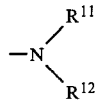

General Formula (VI)

In this formula, $R^{11}$ and $R^{12}$ may be the same or different, and each represents a hydrogen atom; or a substituted or unsubstituted alkyl, alkenyl or aralkyl group which has from 1 to 30 carbon atoms. $R^{11}$ *and* $R^{12}$ may be a linear chain (for example, methyl, ethyl, n-propyl, n-butyl, n-octyl, allyl, 3-butenyl, benzyl, 1-naphthylmethyl), a branched chain (for example, iso-propyl, t-octyl) or a cyclic form (for example, cyclohexyl) or they may be aryl groups (for example, phenyl).

Furthermore, $R^{11}$ and $R^{12}$ may be joined together to form a ring, being cyclized in such a way as to form a saturated heterocyclic ring which contains one or more hetero atom(s) (for example, oxygen, sulfur and/or nitrogen atoms), forming, for example, a pyrrolidyl group, a piperidyl group or a morpholino group.

Substituent groups for $R^{11}$ and $R^{12}$ can also include carboxyl groups, cyano groups, halogen atoms (for example, fluorine, chlorine, bromine), hydroxyl groups, alkoxycarbonyl or aryloxycarbonyl groups which have not more than 20 carbon atoms (for example, methoxycarbonyl, ethoxycabonyl, phenoxycarbonyl, benzyloxycarbonyl), alkoxy groups which have not more than 20 carbon atoms (for example, methoxy, ethoxy, benzyloxy, phenethyloxy), monocyclic aryloxy groups which have not more than 20 carbon atoms (for example, phenoxy, p-tolyloxy), acyloxy groups which have not more than 20 carbon atoms (for example, acetyloxy, propionyloxy), acyl groups which have not more than 20 carbon atoms (for example, acetyl, propionyl, benzoyl, mesyl), carbamoyl groups (for example, carbamoyl, N,N-dimethylcarbamoyl, morpholinocarbonyl, piperidinocarbonyl), sulfamoyl groups (for example, sulfamoyl, N,N-dimethylsulfamoyl, morpholinosulfonyl, piperidinosulfonyl), acylamino groups which have not more than 20 carbon atoms (for example, acetylamino, propionylamino, benzoylamino, mesylamino), sulfonamido groups (for example, ethylsulfonamido, p-toluenesulfonylamido), carbonamido groups which have not more than 20 carbon atoms (for example, methylcarbonamido, phenylcarbonamido), ureido groups which have not more than 20 carbon atoms (for example, methylureido, phenylureido), amino groups (the same as for general formula (VI)), and ammonium groups (the same as for general formula (VI)).

The ammonium groups for B may have substituent groups, and those which can be represented by general formula (VII) are preferred.

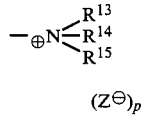

General Formula (VII)

In this formula, $R^{13}$, $R^{14}$ and $R^{15}$ are similar groups to $R^{11}$ and $R^{12}$ in general formula (VI) described earlier, and $Z^-$ represents an anion, such as a halide ion (for example $Cl^{\ominus}$, $Br^{\ominus}$, $I^{\ominus}$), a sulfonate ion (for example, trifluoromethanesulfonate, p-toluenesulfonate, benzenesulfonate, p-chlorobenzenesulfonate), a sulfate ion (for example, ethylsulfate, methylsulfate), a perchlorate ion or a tetrafluoroborate ion. Moreover, p represents 0, 1, 2 or 3 and has a value of 0 when the compound forms an intramolecular salt.

The nitrogen-containing heterocyclic groups represented by B are five or six membered rings which contain at least one nitrogen atom. The rings may have substituent groups and they may be condensed with other rings. Examples of the nitrogen-containing heterocyclic groups include imidazolyl groups, pyridyl groups, thiazolyl groups and triazolyl groups.

M of general formula (V) represents a hydrogen atom, an alkali metal atom (for example, sodium, potassium), an alkaline earth metal atom (for example, calcium, magnesium), an ammonium group (for example, trimethyl ammonium, dimethylbenzylammonium), a phosphonium group (tetrabutylphosphonium, trimethylbenzylphosphonium), or a group which can form a hydrogen atom or alkali metal atom under alkaline conditions (for example, acetyl, cyanoethyl, methanesulfonylethyl) or an amidino group.

In those cases where $Y_o$ represents a group which has a thioamido linkage, the compounds of general formula (II) can be represented by the general formula (VIII) or the general formula (IX) indicated below.

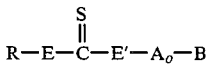

General Formula (VIII)

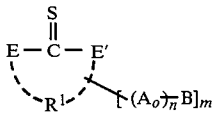

General Formula (IX)

In these formulae, $A_o'$, B, m and n all have the same significance as in the aforementioned general formula (II). Both E and E' represent

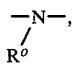

or one represents

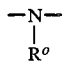

and the other represents —O—, —S— or

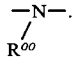

$R^o$ and $R^{oo}$ each represent a hydrogen atom, an aliphatic group having 1 to 18 carbon atoms or an aromatic group having 6 to 18 carbon atoms. R represents a hydrogen atom, an aliphatic group having 1 to 18 carbon atoms or an aromatic group having 6 to 18 carbon atoms. The above mentioned aliphatic groups and aromatic groups may also have substituent groups as discussed for $R_1$ in the aforementioned general formula (I). R' represents a group of atoms which links E and E' together to form a five or six membered ring. Additionally, the ring that is formed may be condensed with an aromatic ring.

Groups derived from thiourea, thiourethane and dithiocarbamic acid esters, for example, are thioamido groups which can be represented by general formula (VIII). Rings known as the acidic nuclei of merocyanine dyes are examples of the five and six membered rings formed by R' in general formula (IX). Some specific examples of such rings are 4-thiazolin-2-thione, thiazolidine-2-thione, 4-oxazolin-2-thione, oxazolidine-2-thione, 2-pyrazolin-5-thione, 4-imidazolin-2-thione, 2-thiohydantoin, rhodanine, isorhodanine, 2-thio-2,4-oxazolidin-dione, thiobarbituric acid, tetrazolin-5-thione, 1,2,4-triazolin-3-thione, 1,3,4-thiadiazolin-2-thione, 1,3,4-oxadiazolin-2-thione, benzimidazolin-2-thione, benzoxazolin-2-thione, benzothiazolin-2-thione and benzselenazolin-2-thione. Tetrazolin-5-thione and 1,3,4-thiadiazolin-2-thione rings are preferred, and tetrazolin-5-thione ring is especially desirable. Furthermore, these rings may be further substituted, and the substituent groups may be the same as those described for the heterocyclic rings formed by Q in the aforementioned general formula (V).

In those cases where $Y_o$ represents a group which has a mercapto group the compounds of general formula (II) can be represented by the general formula (X) indicated below.

$$Z\text{-}[(A_o)_n B]_m \qquad (X)$$

In this formula, $A_o$, B, m and n have the same significance as in the general formulae described earlier, and Z represents an aliphatic mercapto group having 1 to 18 carbon atoms, an aromatic mercapto group having 6 to 18 carbon atoms or a heterocyclic mercapto group (those cases where there is a nitrogen atom adjacent to the carbon atom to which the —SH group is bonded are examples of cyclic thioamido groups to which they are related tautomerically and which have been described already). Examples of aliphatic mercapto groups include mercaptoalkyl groups (for example, mercaptoethyl, mercaptopropyl), mercaptoalkenyl groups (for example, mercaptopropenyl) and mercaptoalkynyl groups (for example, mercaptobutynyl). Examples of aromatic mercapto groups include mercaptophenyl groups and mercaptonaphthyl groups.

Actual heterocyclic mercapto groups include, in addition to those described as cyclic thioamido groups, groups such as 4-mercaptopyridyl, 5-mercaptoquinolinyl, 6-mercaptobenzthiazolyl and mercaptoazaindenyl, for example, and of these the mercaptoazaindenyl group is preferred. Furthermore, these groups can be formed by combining the above mentioned groups arbitrarily, and they may have further substituent groups. The substituent groups for the heterocyclic rings formed by Q in the aforementioned general formula (V) can be used as substituent groups. Furthermore, the above mentioned mercapto groups can form salts of the —SM type, where M has the same significance as in the aforementioned general formula (V).

In those cases where $Y_o$ represents a group which has a disulfide linkage the compound of general formula (II) can be represented by the general formula (XI) describe below.

$$D\text{—}S\text{—}S\text{—}A_o\text{—}B \qquad (XI)$$

In this formula, $A_o$ and B have the same significance as in the aformentioned general formula (II), D represents a substituted or unsubstituted alkyl group, alkenyl group, aralkyl group or aryl group, and these groups may be a linear chain (for example, methyl, ethyl, n-octyl, allyl, 3-butenyl, benzyl, 1-naphthylmethyl), a branched chain (for example, iso-propyl) or a cyclic form (for example cyclohexyl). The substituent groups for $R^{11}$ and $R^{12}$ in the aforementioned general formula (VI) are suitable substituent groups for D, and of these groups the amino groups and ammonium groups are preferred. Furthermore, D and $A_o$ may be joined together to form a ring.

Illustrative compounds which can be represented by the general formula (II) are indicated below, but the invention is not limited to these examples.

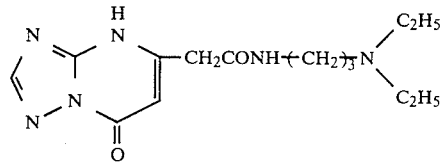

II-1

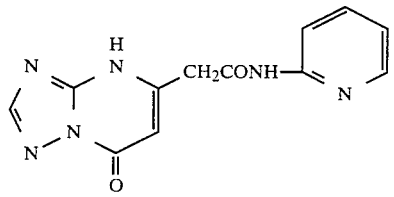

II-2

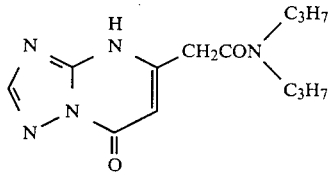

II-3

-continued
II-4
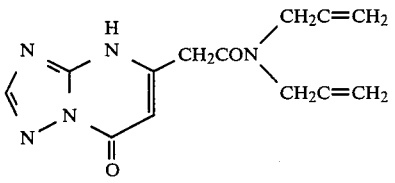
II-5
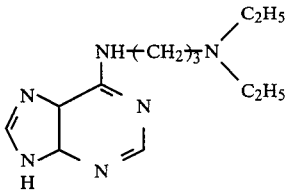
II-6
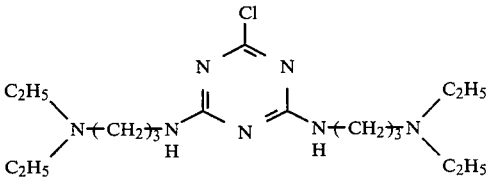
II-7
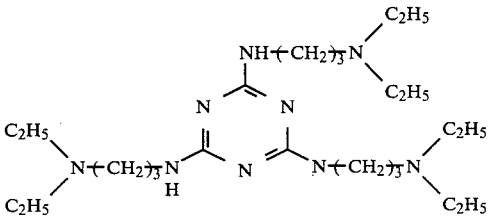
II-8
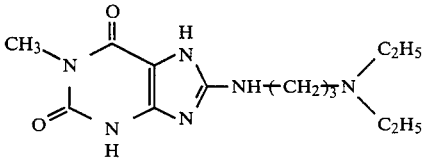
II-9
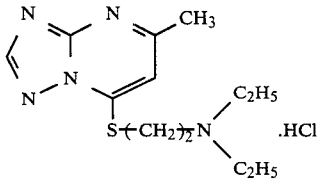
II-10
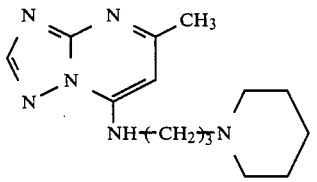
II-11
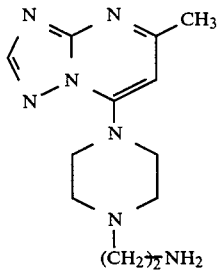

-continued
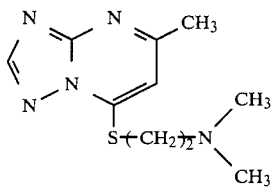
II-12
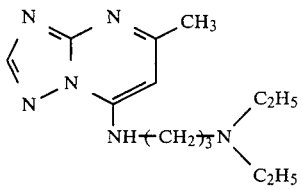
II-13
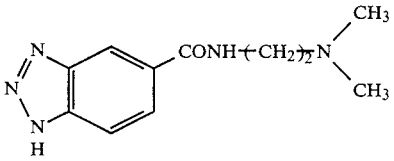
II-14
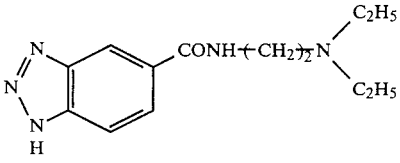
II-15
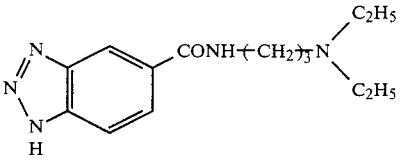
II-16
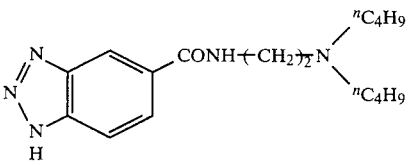
II-17
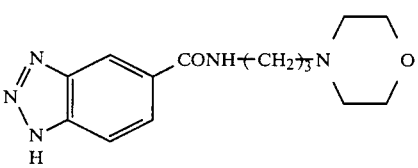
II-18
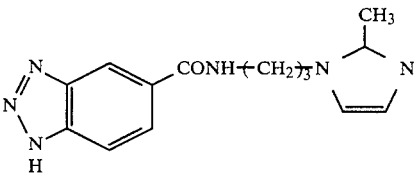
II-19
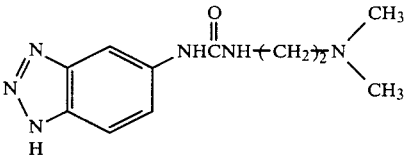
II-20

-continued
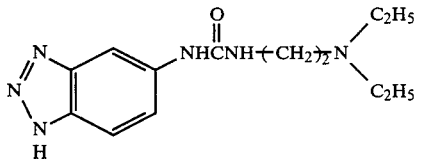
II-21
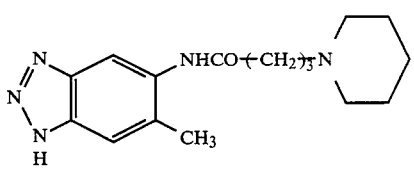
II-22
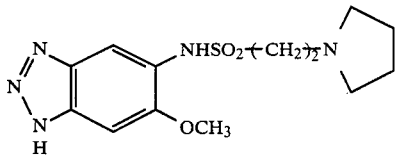
II-23
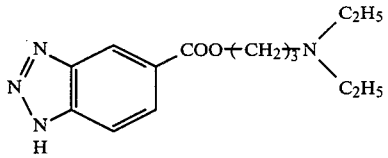
II-24
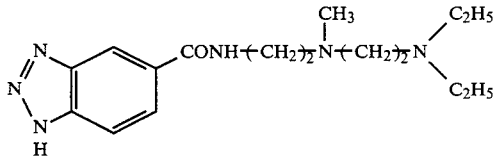
II-25
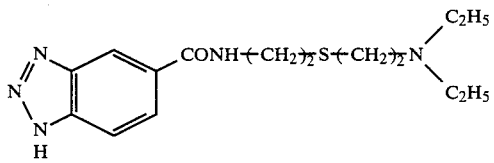
II-26
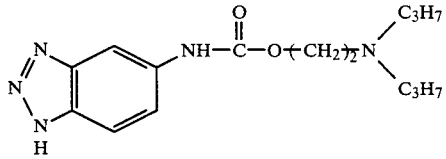
II-27
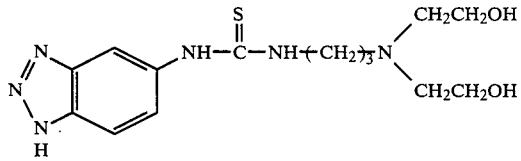
II-28
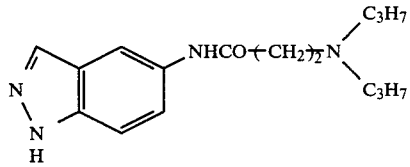
II-29
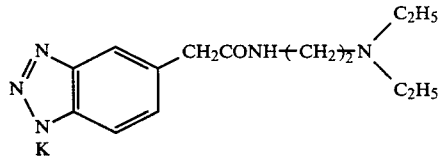
II-30

-continued
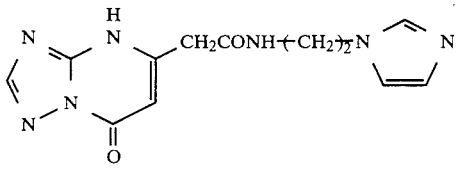
II-31
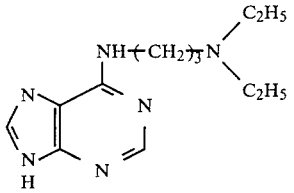
II-32
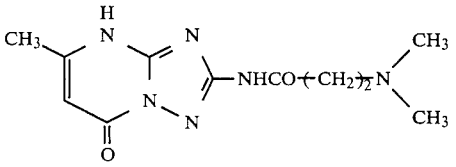
II-33
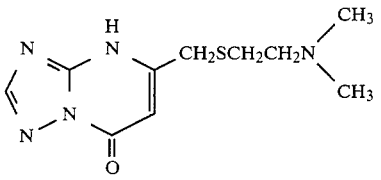
II-34
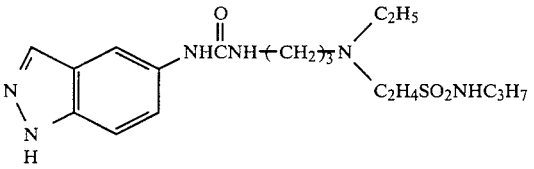
II-35
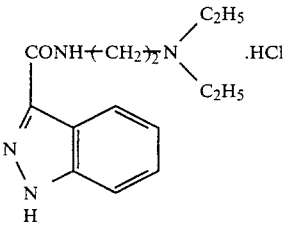
II-36
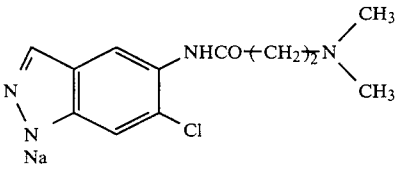
II-37
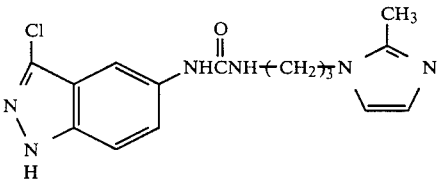
II-38
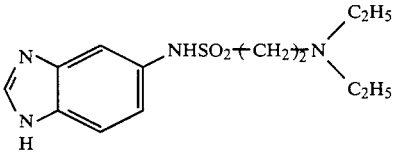
II-39

-continued
II-40
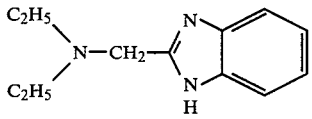
II-41
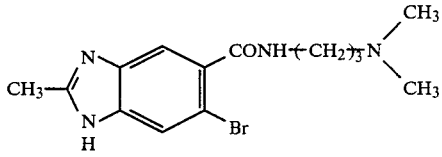
II-42
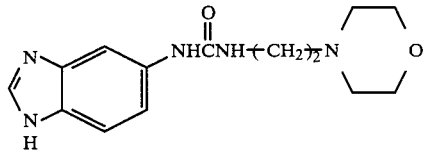
II-43
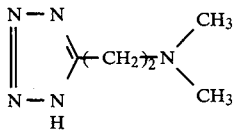
II-44
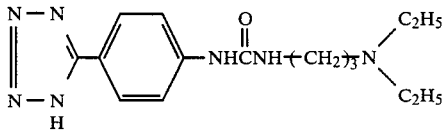
II-45
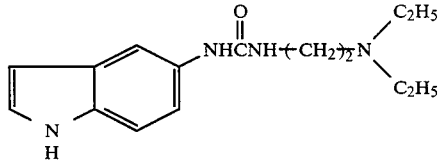
II-46
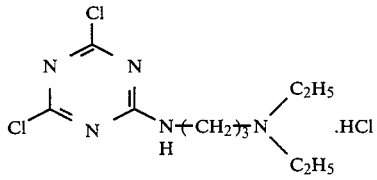
II-47
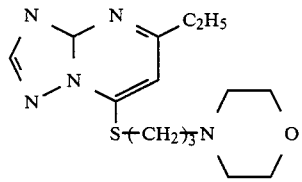
II-48
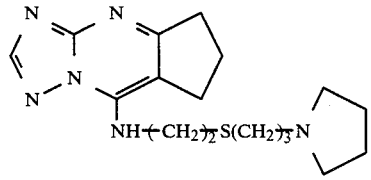
II-49
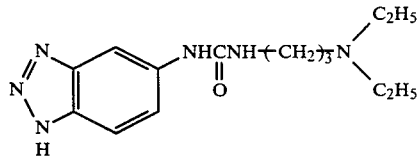

-continued
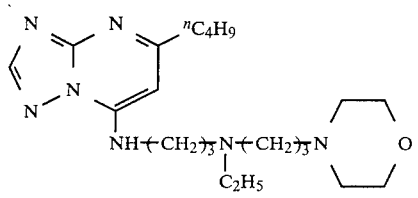
II-50
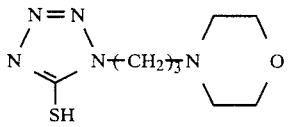
II-51
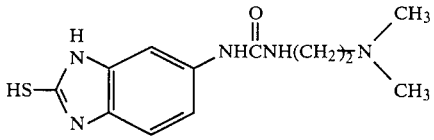
II-52
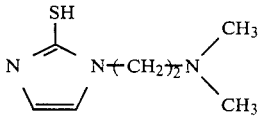
II-53
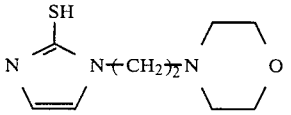
II-54
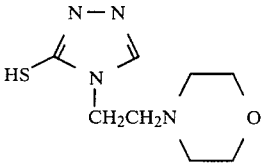
II-55
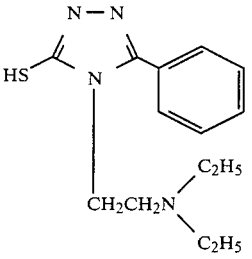
II-56
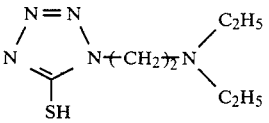
II-57
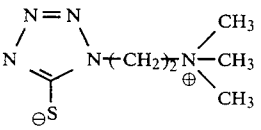
II-58
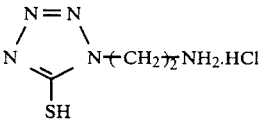
II-59

-continued
II-60
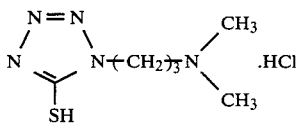
II-61
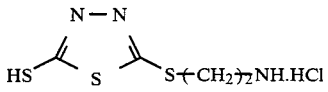
II-62
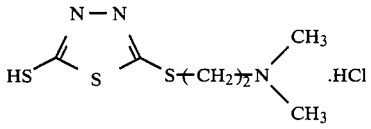
II-63
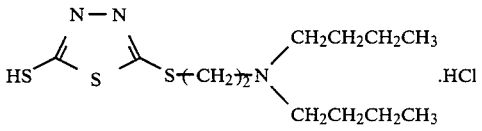
II-64
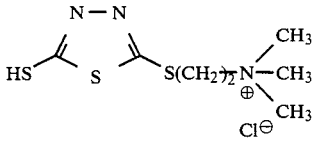
II-65
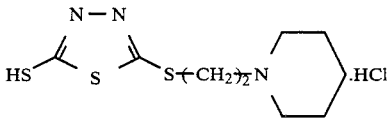
II-66
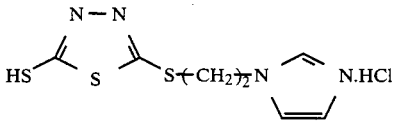
II-67
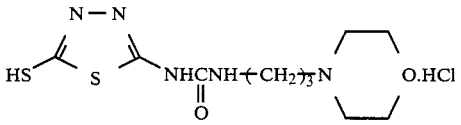
II-68
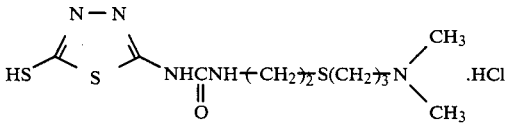
II-69
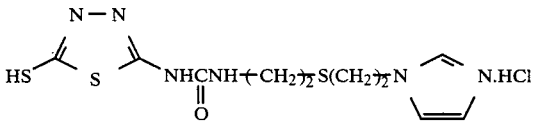
II-70
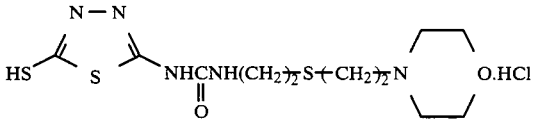
II-71
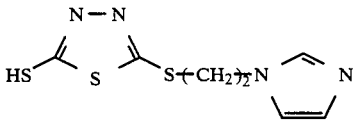

-continued
II-72
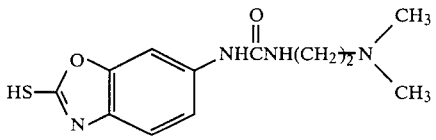
II-73
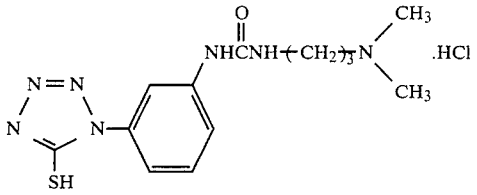
II-74
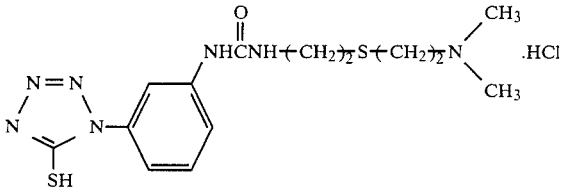
II-75
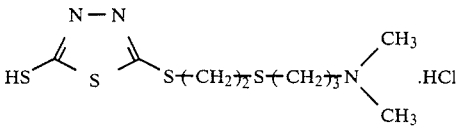
II-76
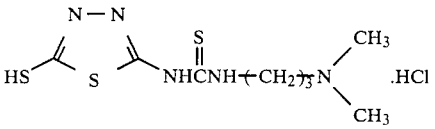
II-77
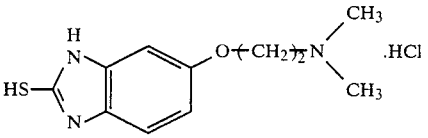
II-78
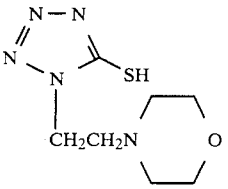
II-79
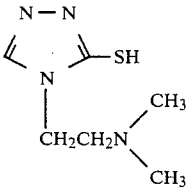
II-80
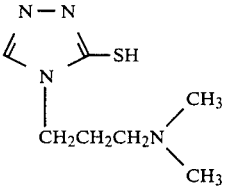

-continued
II-81
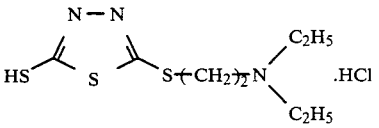
II-82
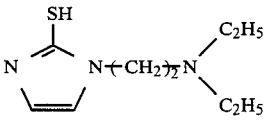
II-83
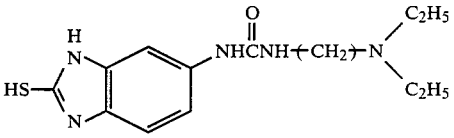
II-84
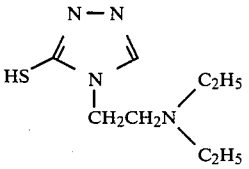
II-85
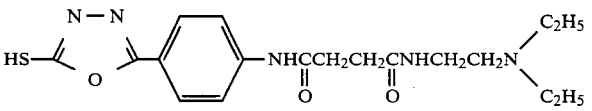
II-86
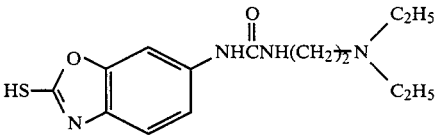
II-87
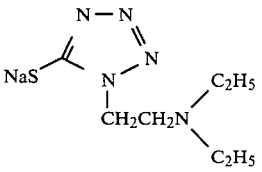
II-88
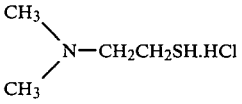
II-89
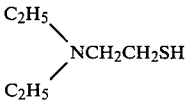
II-90
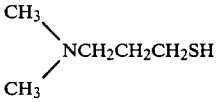
II-91
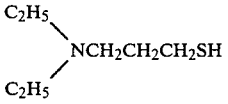
II-92
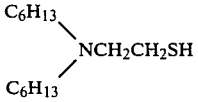

-continued
II-93
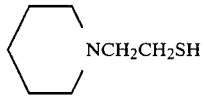
II-94
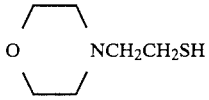
$(HOCH_2CH_2)_2NCH_2CH_2SH$ II-95
II-96
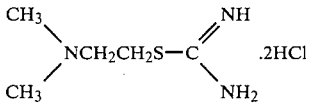
II-97
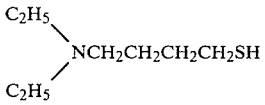
II-98
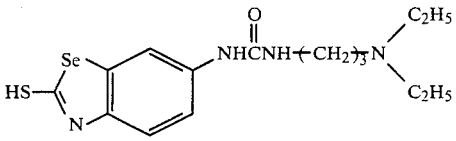
II-99
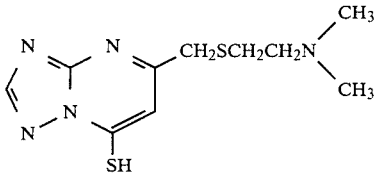
II-100
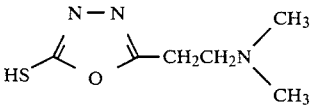
II-101
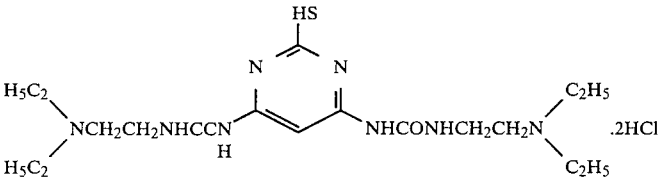
II-102
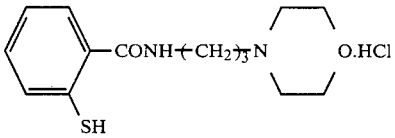
II-103
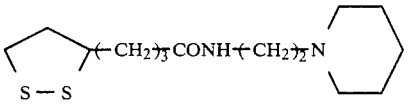
II-104
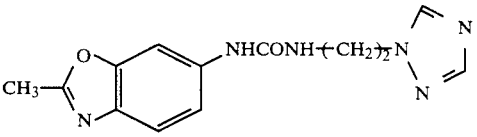

-continued

II-105

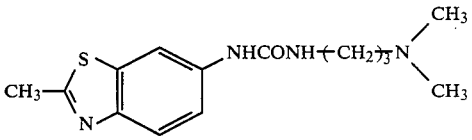

II-106

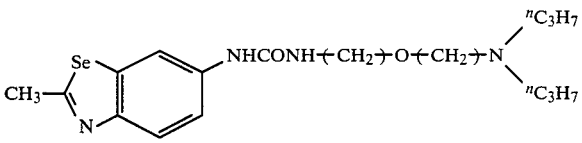

II-107

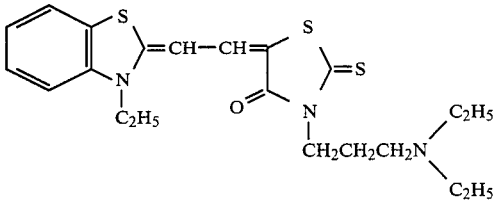

II-108

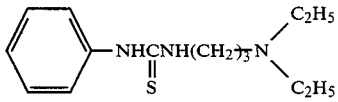

II-109

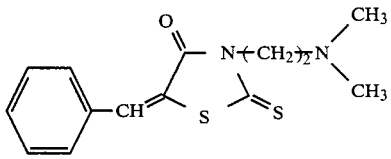

II-110

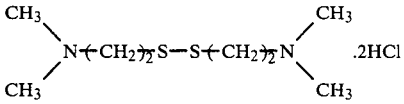

II-111

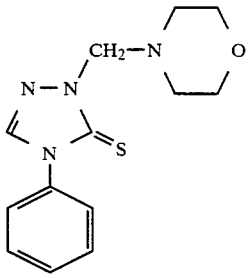

The nucleation accelerating agents used in the present invention can be prepared using the methods disclosed in *Berichte der Deutschen Chemischen Gesellschaft,* 28, 77 (1895); JP-A-50-37436; JP-A-51-3231; U.S. Pat. Nos. 3,295,976 and 3,376,310, *Berichte der Deutschen Chemischen Gesellschaft,* 22, 568 (1889); ibid. 29, 2483 (1896); *J. Chem. Soc.,* 1932, 1806; *J. Am. Chem. Soc.,* 71, 4000 (1949); U.S. Pat. Nos. 2,585,388 and 2,541,924; *Advances in Heterocyclic Chemistry,* 9, 165 (1968); *Organic Synthesis,* IV, 569 (1963); *J. Am. Chem. Soc.,* 45, 2390 (1923); Chemische Berichte, 9, 465 (1876); JP-B-40-28496 (the term "JP-B" as used herein signifies an "examined Japanese patent publication"); JP-A-50-89034; U.S. Pat. Nos. 3,106,467, 3,420,670, 2,271,229, 3,137,578, 3,148,066, 3,511,663, 3,060,028, 3,271,154, 3,251,691, 3,598,599 and 3,148,066; JP-B-43-4135; U.S. Pat. Nos. 3,615,616, 3,420,664, 3,071,465, 2,444,605, 2,444,606, 2,444,607 and 2,935,404; JP-A 57-202531; JP-A-57-167023; JP-A-57-164735: JP-A-60-80839; JP-A-58-152235; JP-A-57-14836; JP-A-59-162546: JP-A-60-130731; JP-A-60-138548; JP-A-58-83852; JP-A-58-159529; JP-A-59-159162; JP-A-60-217358; JP-A-61-80238; JP-B-60-29390; JP-B-60-29391; JP-B-60-133061; JP-B-61-1431; and in accordance with the typical examples of synthesis described hereinafter.

When the compounds represented by the general formulae (I) and (II) are included in a photographic photosensitive material in this invention, they are preferably included in the silver halide emulsion layer, but they can also be included in other light-insensitive hydrophilic colloid layers (for example in protective layers, intermediate layers, filter layers and anti-halation layers). Typically, when the compouns which are to be used are water-soluble they can be added to the hydrophilic colloid solution in the form of an aqueous solution. When they are sparingly soluble in water they may be added in the form of a solution in an organic solvent that is miscible with water, such as an alcohol, an ester or a ketone. These compounds may be in a form in which they are finely dispersed in an organic solvent soluble polymer. When added to a silver halide emulsion layer, the addition can be made at any stage from the commencement of chemical ripening prior to coating. Addition after the completion of chemical ripening and prior to coating is preferred. Addition to the coating liquid prepared for coating is especially desirable.

The appropriate amount of the compound of general formula (I) of this invention to be included is preferably selected in accordance with the following: the grain size of the silver halide emulsion; the halogen composition; the method and extent of chemical sensitization; the relationship between the layer in which the compound is included and the silver halide emulsion layer; and the type of anti-fogging compound being used. The test methods for making such a selection are well known to those involved in the industry. Normally, the addition of an amount within the range of $1\times10^{-6}$ to $1\times10^{-1}$ mol, per mol of silver halide is desirable and an amount within the range of $1\times10^{-5}$ to $1\times10^{-2}$ mol per mol of silver halide is more preferred.

It is not essential that the compound of general formula (I) and the compuond of general formula (II) always be added to the same layer.

The amount of the compound represented by the general formula (II) included is preferably within the range of from $1.0\times10^{-5}$ to 1.0 mol per mole of silver halide and most desirably within the rang from $1.0\times10^{-4}$ to $1.0\times10^{-1}$ mol per mol of silver halide.

The silver halide emulsions used in the present invention may have any composition. They may, for example, be silver chloride, silver chlorobromide, silver iodobromide or silver iodochlorobromide emulsions, but in the case of materials for contact work purposes a silver halide of which the silver chloride content is at least 60 mol %, and preferably at least 75 mol %, is preferred. Silver chlorcbromides or silver chloroiodobromides which have a silver bromide content of from 0 to 5 mol % are preferred.

In the case of materials for screen operation purposes the use of a silver halide which has a silver bromide content of at least 70 mol %, and most desirably at least 90 mol %, is preferred. The use of silver halides which have a silver iodide content of not more than 10 mol %, and most desirably of from 0.1 to 5 mol %, is preferred.

The average grain size of the silver halide used in the present invention is preferably small (for example, not more than 0.7 μm), and an average grain size of not more than 0.5 μm is most disirable. Basically, no limitation is imposed on the grain size distribution, but mono-dispersions are preferred. The term "mono-dispersion" as used herein signifies that the emulsion consists of grains such that at least 95% of the grains either in terms of weight or in terms of the number of grains are of a size within ±40% of the average grain size.

The silver halide grains in the photographic emulsion may have a regular crystalline form, such as a cubic or octahedral form, an irregular crystalline form, such as a spherical or plate-like form, or they may have a form consisting of a composite of these crystalline forms. Grains which have a cubic crystalline form are especially desirable.

The silver halide grains may be such that the interior part and the surface layer consist of a uniform phase, or the interior part and the surface layer may consist of different phases. Mixtures of two or more types of silver halide emulsins which have been prepared separately can also be used.

Cadmium salts, sulfites, lead salts, thallium salts, rhodium salts and complex salts thereof and iridium salt and complex salts thereof can also be included in the silver halide emulsions used in the present invention during the formation or physical ripening process of the silver halide grains.

Rhodium monochloride, rhodium dichloride, rhodium trichloride, and ammonium hexachlororhodinate can be used as rhodium salts. The use of water soluble tri-valent rhodium halogeno-complex compounds, such as hexachlororhodium (III) acid and salts thereof (the ammonium, sodium or potassium salt, for example), is preferred.

The amounts of these water soluble rhodium salts added is within the range of $1.0\times10^{-8}$ to $1.0\times10^{-3}$ mol per mol of silver halide and preferably within the range of $1.0\times10^{-7}$ to $5.0\times10^{-4}$ mol per mol of silver halide.

The silver halide emulsions used in the method of this invention may or may not have been chemically sensitized. Known methods for the chemical sensitizaiton of silver halide emulsions include sulfur sensitization, reduction sensitizaiton and precious metal sensitization. Any of these methods can be used individually or in combinations.

The gold sensitization method is typical of the precious metal sensitization methods, and gold compounds, especially gold complex salts, are used in this method. Precious metals other than gold, for example platinum, palladium, and iridium, can be used as the precious metal instead of gold. Typical examples have been disclosed in U.S. Pat. No. 2,448,060 and British Patent 618,061.

As well as the sulfur compounds which are included in gelatin, various sulfur compounds, such as thiosulfates, thioureas, thiazoles and rhodanines can be used as sulfur sensitizing agents.

Stannous salts, amines, formamidine sulfinic acid, and silane compounds can be used as reduciton sensitizing agents.

Spectrally sensitizing dyes can also be added to the silver halide emulsion layers used in the present invention. Spectrally sensitizing dyes, combinations of useful sensitizing dyes and dyes which exhibit a supersensitizing effect have been disclosed in paragraph IV-J of page 23 of *Research Disclosure,* Vol. 176, No. 17643 (published December, 1978).

The use of gelatin as a binding agent or protective colloid is convenient in photographic emulsions. Other hydrophilic colloids can also be used for this purpose. For example, use can be made of gelatin derivatives, graft polymers made from polymeric materials and gelatin, proteins such as albumin and casein, cellulose derivatives such as hydroxyethylcellulose, carboxymethylcellulose and cellulose sulfate esters, sodium alginate, sugar derivatives such as starch derivatives, and synthetic hydrophilic polymeric materials including homopolymers or copolymers, such as poly(vinyl alcohol), partially acetalated poly(vinyl alcohol), poly-N-vinylpyrrolidone, poly(acrylic acid), poly(methacrylic acid), polyacrylamide, polyvinylimidazole and polyvinylpyrrazole.

Acid treated as well as lime treated gelatins can be used for the gelatin, and use can also be made of gelatin hydrolyzates and enzymitically degraded gelatins.

Various compounds can be included in the photographic materials of the present invention with a view to preventing the occurrence of fogging during the manufacture, storage or photographic processing of the photographic material, or with a view to stabilizing photographic performance. Thus many compounds which are known as anti-fogging agents or stablilizers such as azoles, for example benzothizolium salts, nitroindazoles, chlorobenzimidazoles, bromobenzimidazoles, mercaptothiazoles, mercaptobenzothiazoles, mercaptothiadiazoles, aminotriazoles, benzothiazoles, nitrobenzotriazoles; mercaptopyrimidines; mercaptotriazines; thioketo compounds such as, for example, oxazolinthione; azaindenes, for example, triazaindenes, tetra azaindendes (especially 4-hydroxy substituted (1,3,3a,7)tetra-azaindene) and pentaazaindenes; hydroquinone and derivatives thereof; disulfides, for example thioctic acid; benzenethiosulfonic acid, benzenesulfinic acid, and benzenesulfonic acid amide, can be added for this purpose. The most desirable of these compounds are the benzotriazoles (for example, 5-methylbenzotriazole) and the nitroindazoles (for example, 5-nitroindazole). These compounds may also be included in processing baths.

The photosensitive materials of this invention may contain organic desensitizing agents.

The preferred organic desensitizing agents have at least one water solubilizing group or alkali dissociable group.

Preferred organic desensitizing agents are illustrated in JP-A-63-64039. When organic desensitizing agents are used, they may be included in the silver halide emulsion layer at a rate of $1.0\times10^{-8}$ to $1.0\times10^{-4}$ mol/m$^2$, and preferably at a rate of $1.0\times10^{-7}$ to $1.0\times10^{-5}$ mol/m$^2$.

The compounds disclosed in JP-A-53-77616, JP-A-54-37732, JP-A-53-137133, JP-A-60-140340 and JP-A-60-14959 and various compounds which contain nitrogen or sulfur atoms are also effective as development accelerators and accelerators for nucleation infectious development which are suitable for use in the present invention.

Actual examples are indicated below.

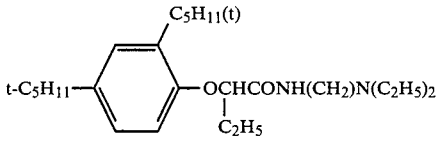

(1)

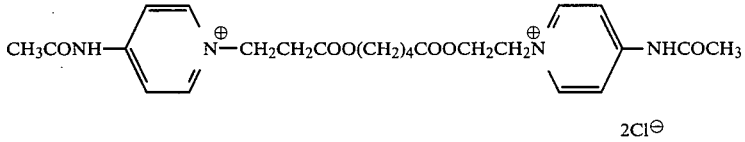

(2)

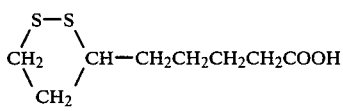

(3)

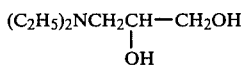

(4)

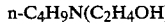

(5)

A plurality of these additive may be used conjointly.

Water soluble dyes can be included in the emulsion layers or other hydrophilic colloid layers in the present invention as filter dyes, for anti-irradiation purposes or for various other purposes. Dyes that are ultraviolet absorbers which have a spectral absorption peak in the intrinsic sensitivity range of the silver halide for reducing the photographic speed, and dyes that have an essential absorption principally in the range from 310 nm to 600 nm for increasing stability under safe lighting when materials are being handled as bright room light-sensitive materials can be used as filter dyes.

These dyes can be added to the emulsion layer depending on the intended purpose. Preferably they are added together with a mordant to a layer above the silver halide emulsion layer, that is to say to light-insensitive hydrophilic colloid layer which is further from the support than the silver halide emulsion layer. The amount added differs according to the molar extinction coefficient of the dye, but it is normally within the range of $10^{-3}$ to 1 g/m$^2$, and most desirably the amount added is within the range of 10 to 500 mg/m$^2$.

The above mentioned dyes can be dissolved in a suitable solvent (for example, water; an alcohol, such as methanol, ethanol and propanol; acetone, methylcellosolve, or a mixture of these solvents), and added to the coating liquid.

Combinations of two or more of these dyes can also be used.

Actual examples of these dyes have been disclosed in JP-A-63-64039.

The ultraviolet absorbing dyes disclosed, for example, in U.S. Pat. Nos. 3,533,794, 3,314,794 and 3,352,681; JP-A-46-2784; U.S. Pat. Nos. 3,705,805, 3,707,375, 4,045,229, 3,700,455 and 3,499,762; and West German Patent Applicaiton No. 1,547,863 can also be used for this purpose.

Futhermore, the pyrazoloneoxanol dyes discolsed in U.S. Pat. No. 2,274,782; the diarylazo dyes disclosed in U.S. Pat. No. 2,956,879; the styryl dyes and butadienyl dyes disclosed in U.S. Pat. Nos. 3,423,207 and 3,384,487; the merocyanine dyes disclosed in U.S. Pat. No. 2,527,583; the merocyanine dyes and oxonol dyes disclosed in U.S. Pat. Nos. 3,486,897, 3,652,284 and 3,718,472; and the enaminohemioxonol dyes disclosed in U.S. Pat. No. 3,976,661; and the dyes disclosed in British Patents 584,609 and 1,177,429; JP-A-48-85130; JP-A-49-99620; JP-A-49-114420; and U.S. Pat. Nos. 2,533,472, 3,148,187, 3,177,078, 3,247,127, 3,540,887, 3,575,704 and 3,653,905 can also be used for this purpose.

Inorganic or organic film hardening agents can also be included in the photographic emulsion layers and other hydrophilic colloid layers of photographic materials of the present invention. Chromium salts (for example, chrome alum, chromium acetate), aldehydes (for example, formaldehyde, glyoxal, glutaraldehyde), N-methylol compounds (for example, dimehtylolurea, methyloldimethylhydantoin), dioxane derivatives (for example, 2,3-dihydroxydioxane), active vinyl compounds (for example, 1,3,5-triacryloyl-hexahydro-s-triazine, 1,3-vinylsulfonyl-2-propanol), active halogen compounds (for example, 2,4-dichloro-6-hydroxy-s-triazine), mucohalogen acids (mucochloric acid, mucophenoxychloric acid), epoxy compounds (for example, tetramethyleneglycol diglycidyl ether), and isocyanate compounds (for example, hexamethylenediisocyanate) can be used individually or in combinations for this purpose.

Furthermore, the polymeric film hardening agents disclosed in JP-A 56-66841, British Patent 1,322,971 and U.S. Pat. No. 3,671,256 can also be used.

Various surfactants can be included for various purposes in the photographic emulsion layers or other hydrophilic colloid layers of the phtotographic materials of the present invention. They may be added as coating promotors, anti-static agents, for improving sliding properties, for emulsification and dispersion purposes, as anti-stick agents, and for improving photographic characteristics (e.g., for accelerating development, increasing contrast or increasing speed).

Use can be made of non-ionic surfactants such as saponin (steroid based), alkyleneoxide derivatives (for example, polyethyleneglycol, polyethyleneglycol/-polypropyleneglycol condensates, polyethyleneglycol alkyl ethers or polyethyleneglycol alkyl aryl ethers, polyethyleneglycol esters, polyethyleneglycol sorbitane esters, polyalkyleneglycol alkylamines or amides, and polyethyleneoxide adducts of silicones), glycidol derivatives (for example, alkenylsuccinic acid polyglyceride and alkylphenol polyglyceride), fatty acid esters of polyhydric alcohols and sugar alkyl esters. Use can be made of anionic surfactants which contain acidic groups, such as carboxyl groups, sulfo groups, phospho groups, sulfate ester groups, phosphate ester groups etc., for example alkylcarboxylates, alkylsulfonates, alkylbenzenesulfonates, alkylnaphthalenesulfonates, alkyl sulfate esters, alkyl phosphate esters, N-acyl-N-alkyltaurines, sulfosuccinic acid esters, sulfoalkylpolyoxyethylenealkylphenyl ethers and polyoxyethylenealkyl phosphate esters. Use can be made of amphoteric surfactants such as amino acids, aminoalkylsulfonic acids, aminoalkyl sulfate or phosphate esters, alkylbetaines and amine oxides. Use can also be made of cationic surfactants, such as alkylamines, aliphatic or aromatic quaternary ammonium salts, heterocyclic quaternary ammonium salts such as pyridinium salts and imidazolium salts, and sulfonium or phosphonium salts which contain an aliphatic or heterocyclic ring.

The polyalkyleneoxides with a molecular weight of at least 600 disclosed in JP-B-58-9412 are preferably surfactants to use in the present invention. Furthermore, polymer latexes, such as a poly(alkyl acrylate) latex can be included in order to provide dimensional stability.

There is no need for the use of conventional infectious developers or highly alkaline developers of pH approaching 13 disclosed in U.S. Pat. No. 2,419,975. Stable developers can be used to obtain superhigh contrast photographic characteristics with the silver halide photographic materials of this invention. That is to say, negative images of sufficiently superhigh contrast can be obtained with the silver halide photographic materials of this invention using developers of pH from 9.5 to 12.3, and preferably of pH from 10.0 to 12.0, which contain at least 0.15 mol/liter of sulfite ion as a preservative.

No particular limitation is imposed on the developing agents which can be used in the method for processing the photographic material of the present invention, and dihydroxybenzenes (for example, hydroquinone), 3-pyrazolidones (for example, 1-phenyl-3-pyrazolidone and 4,4-dimethyl-1-phenyl-3-pyrazolidone), and aminophenols (for example, N-methyl-p-aminophenol) can be used either individually or in combinations for this purpose.

The silver halide photographic materials of the present invention are especially suitable for processing in developers which contain dihydroxybenzenes as the main developing agents and 3-pyrazolidones or aminophenols as auxiliary developing agents. In the preferred developers, dihydroxybenzenes at a concentration in the range of 0.05 to 0.5 mol/liter are used conjointly with 3-pyrazolidones or amino phenols at a concentration of not more than 0.06 mol/liter.

Furthermore, the rate of development can be increased by the addition of amines to the developer, as disclosed in U.S. Pat. No. 4,269,929, resulting in shortened development time.

Moreover, pH buffers such as alkali metal sulfites, carbonates, borates and phosphates, development inhibitors and anti-foggants such as bromides, iodides and organic anti-foggants (nitroindazoles or benzotriazoles are especially desirable) can also be included in the developer. Moreover, hard water softening agents, dissolution promotors, toners, development accelerators, surfactants (polyalkyleneoxides are especially desirable), defoaming agents, film hardening agents and agents which prevent the occurrence of contamination of the film with silver (for example, 2-mercaptobenzimidazolesulfonic acids) can also be included, as required.

The compositions generally used as fixers can be used with the present invention. Additionally, thiosulfates and thiocyanates, organosulfur compounds which are known to have the effect of a fixing agent can be used as fixing agents. Water soluble aluminum salts, for example, can be included in the fixer as film hardening agents.

The processing temperature in the method for processing the photographic material of the present invention is normally selected between 18° C. and 50° C.

The photographic processing is preferably carried out using an automatic processor. Photographic characteristics with a negative gradation of sufficiently superhigh contrast can be obtained even when the overall time from the time at which the photographic material of the present invention enters the automatic processor until it emerges from the processor is set at from 90 seconds to 120 seconds.

The compounds disclosed in JP-A-56-24347 can be used as agents for preventing the occurrence of silver contamination in the developers used in the present invention. The compounds disclosed in JP-A-61-267759 can be used as the dissolution promotors which are added to the developer. Moreover, the compounds disclosed in JP-A-60-93433 or the compounds disclosed in JP-A-62-186259 can be used as the pH buffers which are used in the developer.

The present invention is described in detail below by means of examples. The formulation of the developers used in these examples are also indicated. Unless otherwise indicated, all parts, percents, ratios and the like are by weight.

| | Developer Fomulation | |
|---|---|---|
| | Developer A | Developer B |
| Hydroquinone | 45.0 grams | 45.0 grams |
| N-Methyl-p-aminophenol hemi-Sulfate | 0.8 gram | 0.8 gram |
| Sodium Hydroxide | 1.8 grams | 18.0 grams |
| Potassium Hydroxide | 55.0 grams | 25.0 grams |
| 5-Sulfosalicylic Acid | 45.0 grams | 45.0 grams |
| Boric Acid | 25.0 grams | 25.0 grams |
| Potassium Sulfite | 110.0 grams | 110.0 grams |
| Ethylenediamine Tetra-acetic acid Di-sodium Salt | 1.0 gram | 1.0 gram |
| Potassium Bromide | 6.0 grams | 6.0 grams |
| 5-Methylbenzotriazole | 0.6 gram | 0.6 gram |
| 2-Mercaptobenzimidzole-5-sulfonic Acid | 0.3 gram | 0.3 gram |
| n-Butyldiethanolamine | 15.0 grams | 15.0 grams |
| Water to make up to | 1 liter | 1 liter |
| pH (adjusted with potassium hydroxide) | 11.6 | 10.8 |

EXAMPLE 1

An aqueous solution of silver nitrate and an aqueous solution of potassium iodide and potassium bromide were added simultaneous over a period of 60 minutes to an aqueous gelatin solution which was being maintained at 50° C. in the presence of ammonia and $4\times10^{-7}$ mol of potassium hexachloroiridate per mol of silver while maintaining the pAg value at 7.8 to prepare a cubic, monodisperse emulsion of average grain size 0.28 μm with an average silver iodide content of 0.3 mol %. This emulsion was de-salted using the flocculation method and 40 grams of inactive gelatin per mol of silver was added, after which 5,5'-dichloro-9-ethyl-3,3'-bis(3-sulfopropyl) oxacarbocyanine as a sensitizing dye and a solution containing $10^{-3}$ mol of potassium iodide per mol of silver were added while maintaining the temperature at 50° C. This mixture was aged for 15 minutes after which time the temperature was lowered.

The emulsion was re-dissolved and maintained at 40° C., whereupon the compounds of general formulae (I) and (II) of the present invention were added as indicated in Table 1. Then, 0.5 mol of hydroquinone per mol of silver, 5-methylbenzotriazole, 4-hydroxy-1,3,3*a*,7-tetra-azaindene and poly(ethyl acrylate) latex, and 1,3-vinylsulfonyl-2-propanol (as a gelatin hardening agent) were added and the resulting mixture was coated so as to provide a coated silver weight of 3.4 g/m² on a polyester film (150 μm) on which a subbing layer (0.5 μm) consisting of a poly(vinylidene chloride) polymer had been established.

A layer containing 1.5 g/m² of gelatin, 0.3 g/m² of poly(methyl methacrylate) particles (average particle size 2.5 μm) and the surfactants indicated below was then coated over this layer as a protective layer.

Surfactants:

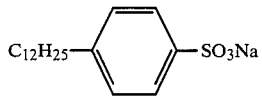

37 mg/m² (1)

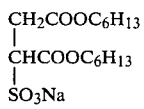

37 mg/m² (2)

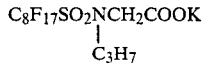

2.5 mg/m² (3)

Comparative Samples 1 to 4 were prepared in the same way except that Comparative Compounds A and B indicated below were used in place of the compounds of general formulae (I) and (II) of the present invention.

Comparative Compound A

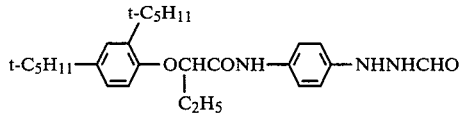

Comparative Compound B

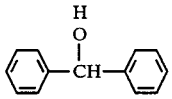

These samples were exposed through an optical wedge to 3200° K. tungsten light, developed for 30 seconds at 34° C. in the aforementioned development baths and then fixed, washed and dried in the usual way. The photographic characteristics obtained were as shown in Table 1.

TABLE 1

| | | Hydrazine Compound | | Development Accelerator | | Developer A (pH 11.6) | | Developer B (pH 10.0) | |
|---|---|---|---|---|---|---|---|---|---|
| | Sample No. | Compound | Amount Added (mol/mol-Ag) | Compound | Amount Added (mol/mol-Ag) | Sensitivity* | Gradation (gamma)** | Sensitivity* | Gradation (gamma)** |
| 1 | Comparative Sample 1 | Comparative Compound A | $4.4\times10^{-3}$ | — | — | Standard | 13.1 | Standard | 3.7 |
| 2 | Comparative Sample 2 | Comparative Compound A | " | II-5 | $5.0\times10^{-3}$ | +0.09 | 19.2 | +0.02 | 4.2 |
| 3 | Comparative Sample 3 | I-1 | " | — | — | ±0.0 | 12.2 | +0.03 | 5.4 |
| 4 | Comparative Sample 4 | " | " | Comparative Compound B | $5.0\times10^{-3}$ | +0.02 | 17.4 | +0.06 | 6.5 |
| 5 | Sample of Invention 1-1 | " | " | II-5 | $5.0\times10^{-3}$ | +0.11 | 23.5 | +0.16 | 14.6 |

TABLE 1-continued

| | Sample No. | Hydrazine Compound | | Development Accelerator | | Developer A (pH 11.6) | | Developer B (pH 10.0) | |
|---|---|---|---|---|---|---|---|---|---|
| | | Compound | Amount Added (mol/mol-Ag) | Compound | Amount Added (mol/mol-Ag) | Sensitivity* | Gradation (gamma)** | Sensitivity* | Gradation (gamma)** |
| 6 | Sample of Invention 1-2 | I-4 | " | " | " | +0.08 | 20.4 | +0.15 | 13.1 |
| 7 | Sample of Invention 1-3 | I-10 | " | " | " | +0.13 | 25.1 | +0.16 | 14.5 |
| 8 | Sample of Invention 1-4 | I-12 | " | " | " | +0.15 | 27.3 | +0.20 | 16.8 |
| 9 | Sample of Invention 1-5 | I-14 | $3.5 \times 10^{-4}$ | " | " | +0.10 | 20.1 | +0.15 | 13.5 |
| 10 | Sample of Invention 1-6 | I-17 | " | " | " | +0.13 | 24.5 | +0.23 | 17.9 |
| 11 | Sample of Invention 1-7 | I-28 | " | " | " | +0.11 | 22.7 | +0.15 | 13.8 |
| 12 | Sample of Invention 1-8 | I-29 | " | " | " | +0.11 | 23.2 | +0.17 | 14.2 |
| 13 | Sample of Invention 1-9 | I-17 | " | II-16 | " | +0.16 | 29.0 | +0.25 | 18.5 |
| 14 | Sample of Invention 1-10 | " | " | II-14 | " | +0.04 | 19.6 | +0.13 | 12.3 |
| 15 | Sample of Invention 1-11 | I-29 | " | II-18 | " | +0.07 | 20.8 | +0.14 | 13.6 |
| 16 | Sample of Invention 1-12 | " | " | II-13 | " | +0.10 | 22.7 | +0.15 | 14.3 |
| 17 | Sample of Invention 1-13 | I-4 | $4.4 \times 10^{-3}$ | II-62 | $4.0 \times 10^{-4}$ | +0.04 | 20.4 | +0.07 | 12.0 |
| 18 | Sample of Invention 1-14 | " | " | II-87 | " | +0.07 | 27.1 | +0.08 | 12.3 |

*Sensitivity: The difference form the sensitivity (Log E) of Comparative sample 1. The sensitivity is expressed as the logarithm of the exposure (log E) required to provide a density of 1.5.

**Gradation (gamma): The gradient of the straight line joining the points of density 0.3 and 3.0 on the characteristic curve. A higher value indicates a harder contrast.

It is clear from Table 1 that the samples of the present invention all exhibited high speed and high contrast, and gradation of at least 10, especially when developed in developer B which had a low pH (pH of 10.8).

EXAMPLE 2

Five types of developer were prepared by changing the potassium hydroxide content to provide a pH of 11.6, 11.4, 11.2, 11.0 and 10.8, the developers being otherwise the same as Developers A and B. Samples 1-1, 1-10, 1-12, 1-17 and Comparative Samples 2 and 4 of Example 1 were then processed in each of these developers in the same way as described in Example 1.

The gradation (gamma values) of the photographic characteristics so obtained were as shown in Table 2. The sensitivity varied in accordance with the gradation.

TABLE 2

| | Sample No. | Gradation (Gamma) Developer pH | | | | |
|---|---|---|---|---|---|---|
| | | 11.6 | 11.4 | 11.2 | 11.0 | 10.8 |
| 1 | Comparative Sample 2 | 19.2 | 12.4 | 6.7 | 4.4 | 4.2 |
| 2 | Comparative Sample 4 | 17.4 | 16.5 | 9.8 | 7.6 | 6.5 |
| 3 | Sample of Invention 1-1 | 23.5 | 23.0 | 21.9 | 17.4 | 14.6 |
| 4 | Sample of Invention 1-10 | 25.1 | 25.1 | 23.7 | 20.0 | 14.5 |
| 5 | Sample of Invention 1-12 | 27.3 | 25.6 | 22.8 | 19.9 | 16.5 |
| 6 | Sample of Invention 1-17 | 24.5 | 24.3 | 22.7 | 21.4 | 17.9 |

It is clear from the results shown in Table 2 that with the comparative samples the gradation changed markedly according to the pH in both cases whereas the extent of the change with the samples of this invention was small. This small pH dependence is a completely new and unexpected result.

EXAMPLE 3

An aqueous solution of silver nitrate and an aqueous solution of silver chloride were mixed simultaneously in the presence of $5.0 \times 10^{-5}$ mol of $(NH_4)_3RhCl_6$ per mol of silver in an aqueous gelatin solution maintained at 30° C. After mixing was complete, soluble salts were removed using a method well known in the industry. Gelatin was then added and 2-methyl-4-hydroxy-1,3,3a,7-tetraazaindene was added as a stabilizer without chemical ripening. This emulsion was a monodisperse emulsion of cubic crystalline form with an average grain size of 0.08 μm.

Compounds selected from among those of general formulae (I) and (II) as shown in Table 3 were added to this emulsion in the amounts shown in Table 3, after which a poly(ethyl acrylate) latex was added at a rate in terms of solid fraction of 30 wt % with respect to the gelatin, and 1,3-vinylsulfonyl-2-propanol was added as a film hardening agent and the resulting mixture was coated in such a way as to provide a coated silver weight of 3.8 g/m$^2$ on a polyester support. The coated weight of gelatin was 1.8 g/m$^2$. A layer containing of 1.5 g/m$^2$ of gelatin and 0.3 g/m$^2$ of poly(methyl methacrylate) of particle size 2.5 μm was coated over the top as a protective layer.

Comparative Samples 5 to 8 were prepared in the same way as in Example 1.

All samples were exposed through an optical wedge using a daylight printer, model p-607 made by the Dainippon Screen Mfg. Co., Ltd., after which they were developed for 20 seconds at 38° C. using Developers A and B, fixed, washed and dried.

The photographic properties obtained were as shown in Table 3.

TABLE 3

| | Sample No. | Hydrazine Compound | | Development Accelerator | | Developer A (pH 11.6) | | Developer B (pH 10.0) | |
|---|---|---|---|---|---|---|---|---|---|
| | | Compound | Amount Added (mol/mol Ag) | Compound | Amount Added (mol/mol Ag) | Sensitivity* | Gradation (gamma)** | Sensitivity* | Gradation (gamma)** |
| 1 | Comparative Sample 5 | Comparative Compound A | $7.0 \times 10^{-3}$ | — | — | Standard | 11.3 | Standard | 5.9 |
| 2 | Comparative Sample 6 | Comparative Compound A | " | II-5 | $1.4 \times 10^{-2}$ | +0.09 | 16.8 | +0.03 | 8.7 |
| 3 | Comparative Sample 7 | I-1 | " | — | — | | | | |
| 4 | Comparative Sample 8 | " | " | Comparative Compound B | $1.4 \times 10^{-2}$ | ±0.0<br>+0.02 | 9.5<br>15.2 | +0.03<br>+0.05 | 6.0<br>7.2 |
| 5 | Sample of Invention 1-1 | I-34 | " | II-5 | $1.4 \times 10^{-2}$ | +0.08 | 18.3 | +0.09 | 10.6 |
| 6 | Sample of Invention 1-2 | I-17 | $5.6 \times 10^{-4}$ | " | " | +0.12 | 21.2 | +0.14 | 12.3 |
| 7 | Sample of Invention 1-3 | I-26 | " | " | " | +0.13 | 23.3 | +0.17 | 14.1 |
| 8 | Sample of Invention 1-4 | I-29 | " | " | " | +0.10 | 18.5 | +0.10 | 10.9 |
| 9 | Sample of Invention 1-5 | I-30 | " | " | " | +0.12 | 22.6 | +0.15 | 13.7 |
| 10 | Sample of Invention 1-6 | I-36 | " | " | " | +0.14 | 25.1 | +0.16 | 14.3 |

In comparison to the comparative samples, the samples of the present invention clearly provided a higher contrast (gamma value).

At pH 10.8 in particular, there was virtually no hardening of contrast with the comparative samples while all of the samples of the present invention gave a high contrast of at least 10.

Furthermore, on investigating the pH dependence in the same way as in Example 2, the samples of the present invention exhibited remarkable little pH dependence when compared with the comparative examples and this is clearly desirable.

While the invention has been described in detail and with reference to specific embodiments thereof, it will be apparent to one skilled in the art that various changes and modifications can be made therein without departing from the spirit and scope thereof.

What is claimed is:

1. A negative-type silver halide photographic material comprising a support having provided thereon at least one hydrophilic colloid layer, at least one of which is a silver halide emulsion layer, wherein said hydrophilic colloid layer contains:

(a) a compound represented by formula (I):

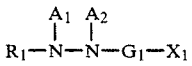

(I)

wherein, $A_1$ and $A_2$ both represent hydrogen atoms, or one represents a hydrogen atom and the other a sulfonyl group or an acyl group, $R_1$ represents an aliphatic group, an aromatic group or a heterocyclic group, $G_1$ represents a carbonyl group, a sulfony group, a sulfoxy group, or a

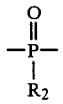

group wherein $R_2$ is an alkoxy group or an aryloxy group,

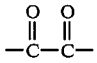

group, or an iminomethylene group, $X_1$ is a moiety which instigates a ring-forming reaction by cleaving the $—G_1—X_1$ moiety from the residual molecule and forming a cyclic structure containing the atoms of the $—G_1—X_1$ moiety; and (b) an amine, represented by general formula (II):

$$Y_o\left[(A_o)_n B\right]_m \quad \text{(II)}$$

wherein $Y_o$ represents a group which promotes adsorption on silver halide, $A_o$ represents a divalent linking group, B represents an amino group, an ammonium group or a nitrogen-containing heterocyclic group, m represents a value of 1, 2 or 3, and n represents a value of 1 or 2, said compound represented by formula (I) and said amine represented by formula (II) being present in the same layer or in different layers.

2. A negative-type silver halide photographic material as in claim 1, wherein $A_1$ and $A_2$ of said formula (I) are selected from the group consisting of hydrogen atoms, alkylsulfonyl groups or arlysulfonyl groups which have not more than 20 carbon atoms, acyl groups which have not more than 20 carbon atoms, and linear chain, branched chain or cyclic unsubstituted or substituted aliphatic acyl groups.

3. A negative-type silver halide photographic material as in claim 2, wherein $A_1$ and $A_2$ are hydrogen atoms.

4. A negative-type silver halide photographic material as in claim 1, wherein $R_1$ of said formula (I) is selected from the group consisting of linear chain, branched chain or cyclic alkyl groups having 1 to 18 carbon atoms, alkenyl groups having 2 to 18 carbon atoms, alkynyl groups having 2 to 18 carbon atoms, monocyclic or bicyclic aryl groups, and from three to ten membered, saturated or unsaturated, heterocyclic groups which contain at least one nitrogen, oxygen or sulfur atom.

5. A negative-type silver halide photographic material as in claim 1, wherein XI of said formula (I) is represented by general formula (a):

$$-L_1-Z_1 \qquad (a)$$

wherein $Z_1$ is a group which subjects $G_1$ to a nucleophilc attack and splits $G_1-L_1-Z_1$ off from the rest of the molecule and $L_1$ is a divalent organic group which can form a ring structure with $G_1$, $L_1$ and $Z_1$ following a nucleophilic attack on $G_1$.

6. A negative-type silver halide photographic material as in claim 5, wherein $Z_1$ is selected from the group consisting of —OH; —SH; —$NHR_3$ wherein $R_3$ represents a hydrogen atom, an alkyl group having 1 to 18 carbon atoms, an aryl group having 6 to 18 carbon atoms, a heterocyclic group, a —$COR_4$ group or an —$SO_2R_4$ group wherein $R_4$ represents a hydrogen atom, an alkyl group having 1 to 18 carbon atoms, an aryl group having 6 to 18 carbon atoms or a heterocyclic group; a —COOH group; and $$-\overset{O}{\overset{\|}{C}}-R_5 \quad \text{or} \quad -\overset{N-R_{16}}{\overset{\|}{C}}-R_5$$

wherein $R_5$ and $R_6$ represent hydrogen atoms, alkyl groups having 1 to 18 carbon atoms, alkenyl groups having 2 to 18 carbon atoms, aryl groups having 6 to 18 carbon atoms or heterocyclic groups.

7. A negative-type silver halide photographic material as in claim 5, wherein $L_1$ is selected from the group consisting of alkylene groups, alkenylene groups, alkynylene groups, arylene groups, heteroarylene groups, —O—, —S—, —$NR_7$—, —N=, —CO—, —$SO_2$—, and combinations thereof, wherein $R_7$ represents a hydrogen atom, an alkyl group having 1 to 18 carbon atoms or an aryl group having 6 to 18 carbon atoms.

8. A negative-type silver halide photographic material as in claim 5, wherein $X_1$ of said formula (I) is represented by general formula (b) or general formula (c):

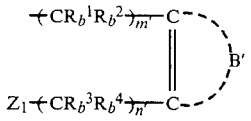

(b)

wherein $Z_1$ has the same significance as in general formula (a), $R_b^1$–$R_b^4$, which may be the same or different, each represents a hydrogen atom, an alkyl group, an alkenyl group or an aryl group, B' represents the atoms required to complete a five or six membered ring which may have substituent groups, and m' and n' each have a value of 0 or 1, provided that when $Z_1$ is a —COOH group, (m'+n') has a value of 0 or 1 and when $Z_1$ is an —OH group, an —SH group or an —$NHR_3$ group then (m'+n') has a value of 1 or 2;

$$-(\overset{R_c^3}{\overset{|}{N}})_p-(CR_c^1R_c^2)_q-Z_1 \qquad (c)$$

wherein $R_c^1$ and $R_c^2$, which may be the same or different, each represents a hydrogen atom, an alkyl group having 1 to 18 carbon atoms, an alkenyl group having 2 to 18 carbon atoms, an aryl group having 6 to 18 carbon atoms or a halogen atom, $R_c^3$ represents a hydrogen atom, an alkyl group, an alkenyl group or an aryl group, $Z_1$ has the same significance as in general formula (a), p represents 0 or 1, and q represents a number of value from 1 to 4.

9. A negative-type silver halide photographic material as in claim 1, wherein $Y_o$ of said general formula (II) is selected from the group consisting of nitrogen-containing heterocyclic groups, groups which have a thioamido linkage, groups which have a mercapto group and groups which have a disulfide linkage.

10. A negative-type silver halide photographic material as in claim 1, wherein the divalent linking group represented by $A_o$ is selected from the group consisting of linear chain or branched chain alkylene groups, linear chain or branched chain alkenylene groups, linear chain or branched chain aralkylene groups, linear or branched chain alkynylene groups, arylene groups,

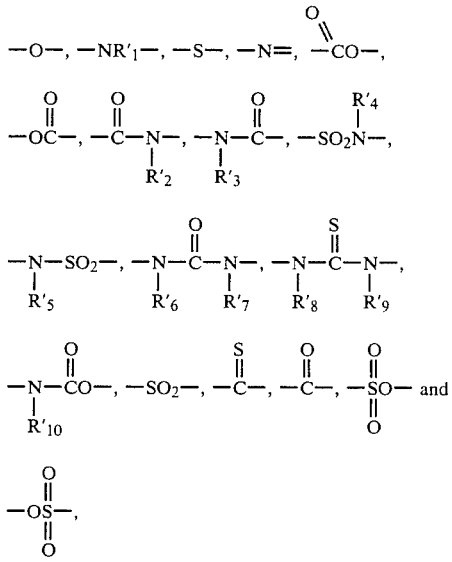

and combinations thereof, wherein $R'_1$, $R'_2$, $R'_3$, $R'_4$, $R'_5$, $R'_7$, $R'_8$, $R'_9$ and $R'_{10}$ each represents a hydrogen atom, a substituted or unsubstituted alkyl group, a substituted or unsubstituted aryl group, a substituted or unsubstituted alkenyl group, or a substituted or unsubstituted aralkyl group.

11. A negative-type silver halide photographic material as in claim 1, wherein $1\times10^{-6}$ to $1\times10^{-1}$ mol of said compound represented by said formula (I) are present per mol of silver halide present in said photographic material.

12. A negative-type silver halide photographic material as in claim 11, wherein $1\times10^{-5}$ to $1\times10^{-2}$ mol of said compound represented by said formula (I) are present per mol of silver halide present in said photographic material.

13. A negative-type silver halide photographic material as in claim 1, wherein about from $1\times10^{-5}$ to 1.0 mol of said amine are present per mol of silver halide present in said photographic material.

14. A negative-type silver halide photographic material as in claim 13, wherein about from $1\times10^{-4}$ to $1.0\times10^{-1}$ mol of said amine are present per mol of silver halide present in said photographic material.

* * * * *